US010607560B2

(12) United States Patent
Tsuchi et al.

(10) Patent No.: US 10,607,560 B2
(45) Date of Patent: Mar. 31, 2020

(54) SEMICONDUCTOR DEVICE AND DATA DRIVER

(71) Applicant: LAPIS Semiconductor Co., Ltd., Yokohama (JP)

(72) Inventors: Hiroshi Tsuchi, Yokohama (JP); Kenichi Shiibayashi, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 2 days.

(21) Appl. No.: 15/982,207

(22) Filed: May 17, 2018

(65) Prior Publication Data

US 2018/0336862 A1 Nov. 22, 2018

(30) Foreign Application Priority Data

May 17, 2017 (JP) ..... 2017-098404

(51) Int. Cl.
*G09G 3/36* (2006.01)

(52) U.S. Cl.
CPC ..... *G09G 3/3688* (2013.01); *G09G 3/3614* (2013.01); *G09G 3/3685* (2013.01); *G09G 2310/0291* (2013.01); *G09G 2320/0252* (2013.01); *G09G 2330/021* (2013.01)

(58) Field of Classification Search
CPC ..... G09G 3/3688; H03F 3/45
See application file for complete search history.

(56) References Cited

U.S. PATENT DOCUMENTS

2007/0159248 A1* 7/2007 Tsuchi ..... H03F 3/3022 330/253
2011/0080214 A1* 4/2011 Tsuchi ..... G09G 3/3688 330/69
2011/0148893 A1* 6/2011 An ..... G09G 3/3614 345/545
2011/0199366 A1* 8/2011 Tsuchi ..... G09G 3/3688 345/212
2012/0127138 A1* 5/2012 Tsuchi ..... H03F 1/0261 345/204
2012/0133438 A1* 5/2012 Tsuchi ..... H03F 3/45219 330/257
2016/0240155 A1* 8/2016 Yang ..... H03F 1/0277

FOREIGN PATENT DOCUMENTS

JP 2009-246741 A 10/2009

* cited by examiner

*Primary Examiner* — William Boddie
*Assistant Examiner* — Andrew B Schnirel
(74) *Attorney, Agent, or Firm* — Rabin & Berdo, P.C.

(57) ABSTRACT

A semiconductor device for driving a load of an object includes a differential circuit receiving an input signal and outputting differential output signals, first to fourth output circuits receiving the differential output signals, and a control circuit configured to respectively connect or disconnect the differential circuit to each of the first to fourth output circuits. The first output circuit is connected between high-level and mid-level power supply terminals and outputs a first output signal to the differential circuit, the second output circuit is connected between the high-level and mid-level power supply terminals, and outputs a second output signal to the load, a third output circuit is connected between mid-level and low-level power supply terminals, and outputs a third output signal to the differential circuit, and a fourth output circuit is connected between the mid-level low-level power supply terminals, and outputs a fourth output signal to the load.

17 Claims, 10 Drawing Sheets

SEMICONDUCTOR DEVICE AND DATA DRIVER

CROSS REFERENCE TO RELATED APPLICATIONS

This application is based upon and claims the benefit of priority of the prior Japanese Patent Application No. 2017-098404, filed on May 17, 2017, the entire contents of which are incorporated herein by reference.

BACKGROUND OF THE INVENTION

Technical Field

The present invention relates to a semiconductor device such as a semiconductor device suitably used for a data driver of a liquid crystal display device.

Background Arts

Currently, active matrix liquid crystal display devices are the main stream of display devices. Liquid crystal display devices are widely used for various types of display devices from portable information devices such as smartphones and tablets to large screen monitors and TVs with high resolution such as 2K4K.

A data driver that drives a display panel needs to perform a highly accurate gradation voltage output and high-speed driving of data lines so as to make possible the high-quality display and video display. This requires output circuits of the data driver to have a high driving capacity so that the data line capacity of the display panel can be charged and discharged rapidly. Also, in order to realize desired display quality, it is necessary to ensure the gradient of the driving waveform upon charging and discharging the data lines, i.e., the through-rate of the output circuits of the data driver, is symmetric and even.

An amplifier configured to drive the data line load directly without using an output switch is proposed as a high-speed driving amplifier for the data lines (see Japanese Patent Application Laid-open Publication No. 2009-246741 (Patent Document 1, for example). The output circuit of the high-speed amplifier includes a differential stage (differential circuit), a first output stage receiving the output of the differential stage, a second output stage directly connected to a data line load, and a control circuit including a switch connected between the output terminals of the first output stage and the second output stage so as to switch the second output stage between an active state and an inactive state. The first output stage and the second output stage receive a high-level power supply VDD and a low-level power supply VSS. In this output circuit, first, the switch between the respective output terminals is turned off in a period T1 in the beginning of the first data period so that the second output stage is inactive. Then, in a period T2 that follows the period T1, the switch between the respective output terminals is turned on so that the second output stage is activated. This way, the data line load is driven from the start of the period T2.

SUMMARY OF THE INVENTION

In liquid crystal displays, the transmittance is controlled in gradation by the level voltages applied to the liquid crystal. In order to prevent the degradation of the liquid crystal, it is necessary to change the polarity of voltage to be applied to the liquid crystal at a certain interval, and generally, a driving method to drive the data lines by switching the gradation voltage between the positive polarity and the negative polarity with respect to a constant common voltage at certain intervals is employed. Such driving methods include the dot-inversion driving in which the positive polarity and the negative polarity are switched in every data period, and the column-inversion driving in which the positive polarity and the negative polarity are switched in every frame period (screen refresh period).

The data driver of the dot-inversion driving uses, for the output circuit, a Full VDD amp that uses the two power supplies of high-level power supply VDD and low-level power supply VSS (=GND) to output gradation voltages of positive polarity and negative polarity. On the other hand, the data driver of the column-inversion driving uses, for the output circuit, a half VDD amp that uses three power supplies of high-level power supply VDD, mid-level power supply VDM (near common voltage), and low-level power supply VSS (=GND) to output gradation voltages of positive polarity and negative polarity.

In recent years, the column-inversion driving is becoming more and more popular as compared to the dot-inversion driving for the driving method of the data driver in order to reduce the power consumption. With respect to the three power supplies of the low-level power supply VSS, the mid-level power supply VDM, and the high-level power supply VDD, the voltage range of the common voltage is in the vicinity of the mid-level power supply VDM, the voltage range of the positive polarity gradation voltage is between the high-level power supply VDD and the mid-level power supply VDM, and the voltage range of the negative polarity gradation voltage is between the low-level power supply VSS and the mid-level power supply VDM. Also, in many cases, the charge-sharing driving is employed to reduce the power consumption. In the charge-sharing driving, the data lines that receive the gradation voltage of the same polarity during the period T1 are short-circuited to reuse the electrical charges between the load capacity of the previous data period for the driving operation of the next data period.

When the circuit disclosed in Patent Document 1 described above is operated as a positive polarity driving amp for the column inversion driving, the first output stage and the second output stage receive the mid-level power supply VDM instead of the low-level power supply VSS. In an Nch output transistor M2 of the first output stage, and an Nch output transistor M4 of the second output stage, the source is supplied with the mid-level power supply VDM, but the back gate is supplied with VSS to prevent the latch-up due to the parasitic bipolar operation. For this reason, the Nch output transistors M2 and M4 receive a high back-bias voltage, which increases the threshold voltage. Such an increase in threshold voltage due to the application of the back-bias voltage would cause major distortion and output delay in the output waveform of the discharging operation.

That is, in the period T1, the first output stage is in operation, and the potentials of the gates of the Nch output transistors M2 and M4 are respectively (VDM+Vtn+dVn) and (VDM). Vtn is the threshold voltage of the Nch output transistors M2 and M4, dVn is the difference (Vgs−Vtn) between Vtn and the gate-source voltage Vgs when the output is stable. Because the back gate of the output transistors M2 and M4 is VSS, the back-bias voltage corresponding to the source potential is applied to the back gate. This causes the threshold voltage Vtn to be higher than the threshold voltage when the back-bias voltage is not applied.

When the second output stage is activated in the period T2, the respective gates of the Nch output transistors M2 and M4 are short-circuited, and due to the capacitance coupling between the gate parasitic capacitances, the gate potential of M2 is pulled by M4, which causes both of the Nch output transistors M2 and M4 to be turned off, and then turned on. That is, because a difference in gate potentials between the Nch output transistors M2 and M4 is large in the period T1, when the respective gates are connected at the beginning of the period T2, both transistors are temporarily turned off due to the capacitance coupling between the gates. This OFF period is longer as the difference in gate potential in the period T1 is larger.

On the other hand, the Pch output transistors M1 and M3 do not receive the back-bias voltage, and therefore, the difference in gate potentials during the period T1 is about the same as the normal threshold voltage. The respective gates are connected at the beginning of the period T2, and both transistors are temporarily turned off due to the capacitance coupling, but this OFF period is shorter than that of the Nch output transistors M2 and M4 that receive the back-bias voltage. Thus, the output waveform of the discharging operation by the Nch output transistors M2 and M4, which has the longer OFF period at the beginning of the period T2 than that of the Pch output transistors M1 and M3, has greater distortion or output delay. Particularly, if the charge sharing driving is performed during the period T1, electric charges move towards the data line load during the period in which both Nch output transistors M2 and M4 are off immediately after the start of the period T2, which causes even greater waveform distortion.

Similarly, if the circuit disclosed in Patent Document 1 described above is operated as a negative polarity driving amp for the column inversion driving, great distortion and output delay occur in the output waveform of the charging operation.

The present invention was made in view of the above-described problem, and is aiming at providing a semiconductor device that can obtain an output waveform with minimum distortion or delay in a data driver of a display device.

According to an aspect of the invention, a semiconductor device for driving a load of an object, including a driving output terminal connected to the load, a high-level power supply terminal that receives a high-level power supply potential, a low-level power supply terminal that receives a low-level power supply potential, a mid-level power supply terminal that receive a mid-level power supply potential that is in between the high-level power supply potential and the low-level power supply potential, a differential circuit having a first input configured to receive an input signal, a second input, and a pair of outputs configured to output differential output signals generated by the differential circuit, a first output circuit connected between the high-level power supply terminal and the mid-level power supply terminal, and being configured to receive the differential output signals from the differential circuit, generate a first output signal, and output the first output signal to be inputted to the second input of the differential circuit, a second output circuit connected between the high-level power supply terminal and the mid-level power supply terminal, the second output circuit being configured to receive the differential output signals from the differential circuit, generate a second output signal, and output the second output signal to be outputted through the driving output terminal, a third output circuit connected between the mid-level power supply terminal and the low-level power supply terminal, the third output circuit being configured to receive the differential output signals from the differential circuit, generate a third output signal, and output the third output signal to be inputted to the second input of the differential circuit, a fourth output circuit connected between the mid-level power supply terminal and the low-level power supply terminal, the fourth output circuit being configured to receive the differential output signals from the differential circuit, generate a fourth output signal, and output the fourth output signal to be outputted through the driving output terminal, an output control switch connected between the second input of the differential circuit and the driving output terminal, and a control circuit configured to respectively connect or disconnect the differential circuit to each of the first to fourth circuits and connect or disconnect the second input of the differential circuit to the driving output terminal.

According to another aspect of the invention, a semiconductor device for driving a load of an object, a first supply voltage, and a second supply voltage being supplied to the semiconductor device, including a differential circuit having a first input and a second input, and being configured to receive an input signal through the first input, and output differential output signals generated by the differential circuit, the input signal being of a first polarity voltage or a second polarity voltage, a first circuit driven by the first supply voltage, and having an on-state, the first circuit being configured to, in the on-state, receive the differential output signals when the input signal is the first polarity voltage that is inputted to the differential circuit, generate a first output signal and a second output signal, and output the first output signal and the second output signal, at least one of the first output signal and the second output signal being inputted to the second input of the differential circuit, the second output signal being outputted to the load, a second circuit driven by the second supply voltage, and having an on-state, the first and second circuits being connected to the differential circuit in parallel, the second circuit being configured to, in the on-state, receive the differential output signals when the input signal is the second polarity voltage that is inputted to the differential circuit, generate a third output signal and a fourth output signal, and output the third output signal and the fourth output signal, at least one of the third output signal and the fourth output signal being inputted to the second input of the differential circuit, the fourth output signal being outputted to the load; and a control circuit configured to control one of the first and second circuits being in the on-state by connecting the differential circuit to the one of the first and second circuits.

According to an aspect of the invention, a data driver including a semiconductor device, wherein the data driver is connected to a liquid crystal display device having unit pixels at respective intersections of a plurality of data lines and a plurality of scan lines, the unit pixels each having a pixel switch and a display element, and is configured to drive the data lines as a load to be driven.

According to the semiconductor device of the present invention, it is possible to obtain an output waveform with minimum distortion and delay in the data driver of a display device.

DETAILED DESCRIPTION OF THE INVENTION

Figure 1:
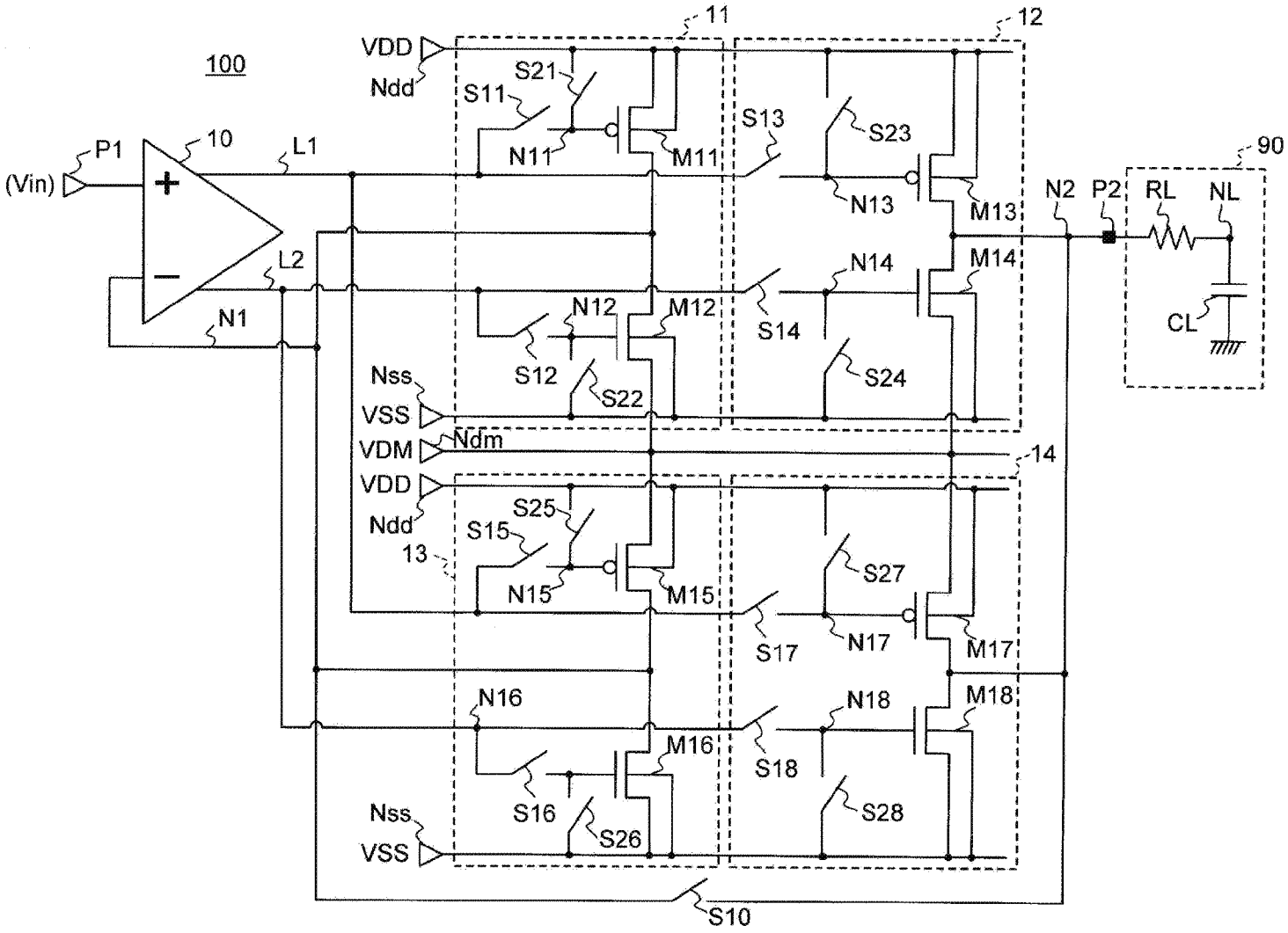
FIG. 1 is a circuit diagram showing the configuration of an output circuit of Embodiment 1.

Embodiments of the present invention will be explained below with reference to figures. In the descriptions of respective embodiments below and appended figures, components and parts that are substantially the same or equivalent to each other are given the same reference characters.

Embodiment 1

As shown in FIG. 1, the semiconductor device of this embodiment includes an output circuit 100 and a data line load 90.

The output circuit 100 includes a differential stage (differential circuit) 10, a first output stage (first output circuit) 11, a second output stage (second output circuit) 12, a third output stage (third output circuit) 13, a fourth output stage (fourth output circuit) 14, and a first node N1 connected to respective output terminals of the first output stage 11 and the third output stage 13, and a second node N2 connected to respective output terminals of the second output stage 12 and the fourth output stage 14. The output circuit 100 also includes an input terminal P1 receiving an input signal Vin, an output pad P2 connected to the data line load 90, a high-level power supply terminal Ndd receiving a high-level power supply potential VDD, and a low-level power supply terminal Nss receiving a low-level power supply potential VSS, and a mid-level power supply terminal Ndm receiving a mid-level power supply potential Vdm that is at a level between the high-level power supply potential VDD and the low-level power supply potential VSS. The second node N2 is connected to the data line load 90 via the output pad P2. The output circuit 100 also includes an output control switch S10 that connects and disconnects the first node N1 and the second node N2, and a plurality of switches that change the state of each of the first to fourth output stages 11 to 14 between the active state and inactive state.

The input terminal P1 is connected to one (+) of the input ends of the differential stage 10. The first node N1, which is the output node of the first output stage 11 and the third output stage 13, is connected to the other input end (−) of the two input ends of the differential stage 10. The differential stage 10 receives the input signal Vin of the input terminal P1 and a signal from the first node N1 in a differential manner, and outputs the differential signal from the first output terminal L1 and the second output terminal L2, which form a pair of output terminals. After receiving the differential signal of the differential stage 10, the first output stage 11 and the third output stage 13 amplify and output an output signal corresponding to the input signal Vin to the first node N1, and the second output stage 12 and the fourth output stage 14 amplify and output an output signal corresponding to the input signal Vin to the second node N2. The input end (−) of the differential stage 10 is connected to the first node N1 that is the output terminal of the first output stage 11 and the third output stage 13 and is also connected to the second node N2, which is the output terminal of the second output stage 12 and the fourth output stage 14, via the output control switch S10. Thus, the output circuit 100 constitutes a differential amplifier circuit in which the first node N1 is fed back to the input terminal (−) of the input pair of the differential stage 10.

The first output stage 11 and the second output stage 12 are interposed between the high-level power supply terminal Ndd and the mid-level power supply terminal Ndm. The output terminal of the first output stage 11 is connected to the input end (−) of the differential stage 10 via the first node N1, and the output terminal of the second output stage 12 is connected to the output pad P2 via the second node N2.

The first output stage 11 includes a first transistor M11 of the first conductivity type (P channel type) connected between the high-level power supply terminal Ndd and the first node N1, and a second transistor M12 of the second conductivity type (N channel type) connected between the first node N1 and the mid-level power supply terminal Ndm. The control terminal (gate) of the first transistor M11 is connected to the first output terminal L1 of the differential stage 10 via a switch S11, and is connected to the high-level power supply terminal Ndd via a switch S21. The control terminal (gate) of the second transistor M12 is connected to the second output terminal L2 of the differential stage 10 via a switch S12, and is connected to the low-level power supply terminal Nss via a switch S22. The back gate of the first transistor M11 is connected to the high-level power supply terminal Ndd, and the back gate of the second transistor M12 is connected to the low-level power supply terminal Nss.

The second output stage 12 includes a third transistor M13 of the first conductivity type (P channel type) connected between the high-level power supply terminal Ndd and the second node N2, and a fourth transistor M14 of the second conductivity type (N channel type) connected between the second node N2 and the mid-level power supply terminal Ndm. The control terminal (gate) of the third transistor M13 is connected to the first output terminal L1 of the differential stage 10 via a switch S13, and is connected to the high-level power supply terminal Ndd via a switch S23. The control terminal (gate) of the fourth transistor M14 is connected to the second output terminal L2 of the differential stage 10 via a switch S14, and is connected to the low-level power supply terminal Nss via a switch S24. The back gate of the third transistor M13 is connected to the high-level power supply terminal Ndd, and the back gate of the fourth transistor M14 is connected to the low-level power supply terminal Nss.

The third output stage 13 and the fourth output stage 14 are interposed between the mid-level power supply terminal Ndm and the low-level power supply terminal Nss. The output terminal of the third output stage 13 is connected to the input end (−) of the differential stage 10 via the first node N1, and the output terminal of the fourth output stage 14 is connected to the output pad P2 via the second node N2.

The third output stage 13 includes a fifth transistor M15 of the first conductivity type (P channel type) connected between the mid-level power supply terminal Ndm and the first node N1, and a sixth transistor M16 of the second conductivity type (N channel type) connected between the first node N1 and the low-level power supply terminal Nss. The control terminal (gate) of the fifth transistor M15 is connected to the first output terminal L1 of the differential stage 10 via a switch S15, and is connected to the high-level power supply terminal Ndd via a switch S25. The control terminal (gate) of the sixth transistor M16 is connected to the second output terminal L2 of the differential stage 10 via a switch S16, and is connected to the low-level power supply terminal Nss via a switch S26. The back gate of the fifth transistor M15 is connected to the high-level power supply terminal Ndd, and the back gate of the sixth transistor M16 is connected to the low-level power supply terminal Nss.

The fourth output stage 14 includes a seventh transistor M17 of the first conductivity type (P channel type) connected between the mid-level power supply terminal Ndm and the second node N2, and an eighth transistor M18 of the second conductivity type (N channel type) connected between the second node N2 and the low-level power supply terminal Nss. The control terminal (gate) of the seventh transistor M17 is connected to the first output terminal L1 of the differential stage 10 via a switch S17, and is connected to the high-level power supply terminal Ndd via a switch S27. The control terminal (gate) of the eighth transistor M18 is connected to the second output terminal L2 of the differential stage 10 via a switch S18, and is connected to the low-level power supply terminal Nss via a switch S28. The back gate of the seventh transistor M17 is connected to the high-level power supply terminal Ndd, and the back gate of the eighth transistor M18 is connected to the low-level power supply terminal Nss.

In the descriptions below, transistors of the first conductivity type (P-channel type) will be referred to as "Pch transistors," and transistors of the second conductivity type (N-channel type) will be referred to as "Nch transistors." The control terminal (gate) of each transistor will be simply referred to as a gate.

The data line load 90 is a data line load (simplified equivalent model) of the display panel, and includes line resistance RL and line capacitance CL. The data line load 90 is connected to the output circuit 100 via the output pad P2. The connection point between the data line load 90 and the output circuit 100 will be referred to as the near end of the data line, and the end portion that is furthest from the output pad P2 will be referred to as the far end of the data line.

The switches S11 (first switch), S12 (second switch), S13 (third switch), S14 (fourth switch), S15 (fifth switch), S16 (sixth switch), S17 (seventh switch), S18 (the eighth switch), S21 (the ninth switch), S22 (the tenth switch), S23 (the eleventh switch), S24 (the twelfth switch), S25 (the thirteenth switch), S26 (the fourteenth switch), S27 (the fifteenth switch), S28 (the sixteenth switch), and the output control switch S10 constitute the control circuit that switch the first output stage 11, the second output stage 12, the third output stage 13, and the fourth output stage 14 between the active state and inactive state.

Specifically, during one data period in which the positive polarity input signal Vin is supplied to the input terminal P1, the first output stage 11 and the second output stage 12 are activated or inactivated so as to output a positive polarity voltage to the data line load 90. In this period, the third output stage 13 and the fourth output stage 14 remain inactive. On the other hand, during one data period in which the negative polarity input signal Vin is supplied to the input terminal P1, the third output stage 13 and the fourth output stage 14 are activated or inactivated so as to output a negative polarity voltage to the data line load 90. In this period, the first output stage 11 and the second output stage 12 remain inactive.

As described above, the back gates of the Pch transistors M11 and M13 are connected to the high-level power supply terminal Ndd as well as each source thereof, and the back gates of the Nch transistors M16 and M18 are connected to the low-level power supply terminal Nss as well as each source thereof. On the other hand, in the Nch transistors M12 and M14, each source is connected to the mid-level power supply terminal Ndm, and each back gate is connected to the low-level power supply terminal Nss. This makes it possible to prevent an electric current from being generated by the parasitic bi-polar effect between the source (mid-level power supply terminal Ndm), the back gate, and the drain (second node N2) when a negative voltage is output from the second node N2.

For example, in a case where the drain and source of each of the Nch transistors M12 and M14 are formed by the N region, and the back gate thereof is formed by the P region, if the back gate is at a higher potential than the drain when the drain (second node N2) receives the negative polarity voltage and is at a lower voltage than the source (mid-level power supply terminal Ndm), the NPN parasitic bipolar is activated, which generates an electric current. Thus, by connecting the back gate of each of the Nch transistors M12 and M14 to the low-level power supply terminal Nss that is always lower than the drain (second node N2), the parasitic bi-polar effect can be avoided. On the other hand, in the Pch transistors M15 and M17, each source is connected to the mid-level power supply terminal Ndm, and each back gate is connected to the high-level power supply terminal Ndd. This makes it possible to prevent an electric current from being generated by the parasitic bi-polar effect when a positive voltage is output from the second node N2.

Next, the operation of connection control by the control circuit will be explained with reference to FIGS. 2 to 4.

Figure 2:
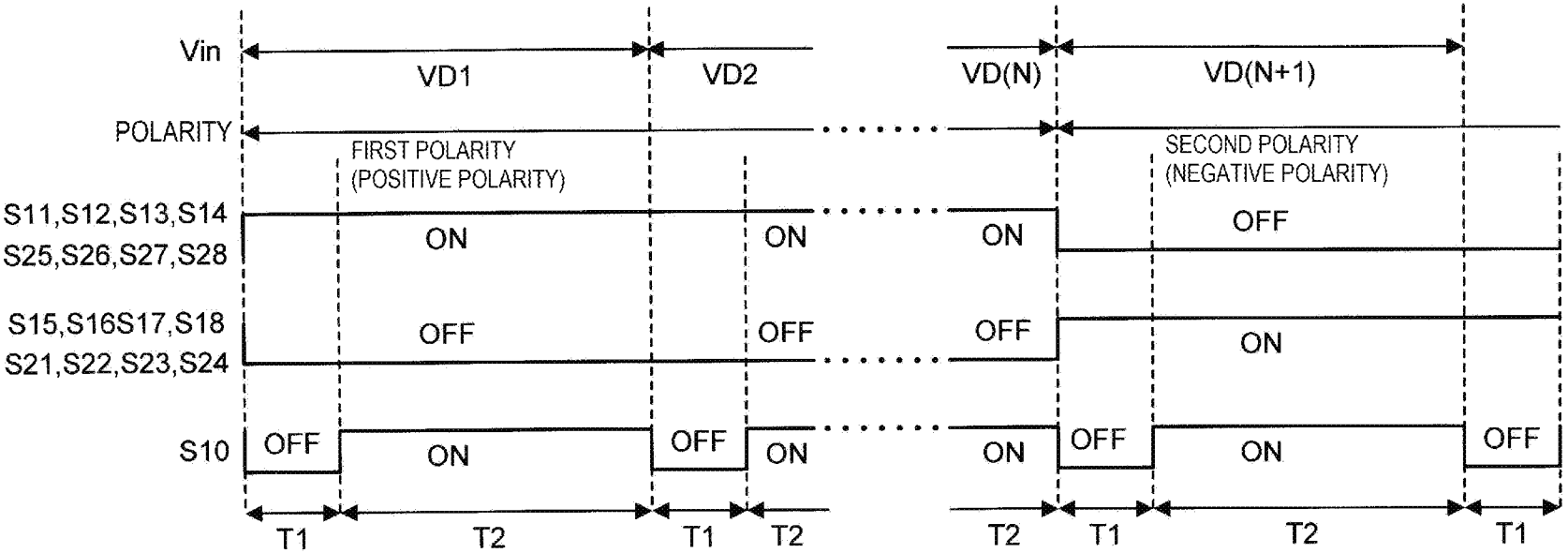
FIG. 2 is a time chart showing a connection control example in Embodiment 1.

FIG. 2 is a time chart showing a connection control example of this embodiment. This figure shows the first to N-th data periods (N is an integer of 1 or greater) and the (N+1)-th data period. In the first to N-th data periods, the first polarity (positive polarity) input signal Vin is input into the input terminal P1, and in the (N+1)-th data period that occurs after the N-th data period, the polarity is switched. In the (N+1) data period, the second polarity (negative polarity) input signal Vin is input into the input terminal P1. The subsequent data periods after the (N+2)-th data period are not shown in the figure.

The input signals Vin input into the respective data periods of the first, second, . . . . N-th, and (N+1)-th data periods are VD1, VD2, . . . VD (N), and VD (N+1), respectively. Each data period is set in the unit of one data period, and each data period includes the first period T1 starting from the start point of one data period, and the second period T2 that follows the first period T1.

In each data period that receives the input signals VD1 to VD(N) of the first polarity (positive polarity) voltage, the switches S11, S12, S13, S14, S25, S26, S27 and S28 are turned on, and the switches S15, S16, S17, S18, S21, S22, S23 and S24 are turned off during the first period T1 and the second period T2. The output control switch S10 is turned off during the first period T1 and turned on during the second period T2.

As a result, in the first period T1, the first node N1 and the second node N2 are not electrically connected, and the first output stage 11 and the second output stage 12 are activated (operated). Among the output terminals L1 and L2 of the differential stage 10, the input node N11 (the gate of the transistor M11) and the input node N12 (the gate of the transistor M12) of the first output stage 11, and the input node N13 (gate of the transistor M13) and the input node N14 (gate of the transistor M14) of the second output stage 12, L1, N11, and N13 are electrically connected, and L2, N12, and N14 are electrically connected. Also, the third output stage 13 and the fourth output stage 14 are inactivated (stopped), and the output terminals L1 and L2 of the differential stage 10 are electrically disconnected from the input node N15 (the gate of the transistor M15) and the input node N16 (the gate of the transistor M16) of the third output stage 13, and the input node N17 (gate of the transistor M17) and the input node N18 (gate of the transistor M18) of the fourth output stage 14.

In the first period T1, with the amplification operation of the differential stage 10 and the first output stage 11, an output voltage corresponding to the input signal Vin is output to the first node N1. At this time, the load of the first node N1 is the internal parasitic capacitance only. Therefore, the potential of the first node N1 can easily follow the input signal Vin, and the output terminals L1 and L2 of the differential stage 10 and the input nodes N11 and N12 of the first output stage 11 have slight potential fluctuations. Since the input nodes N13 and N14 of the second output stage 12 are electrically connected to the output terminals L1 and L2 of the differential stage 10, respectively, only slight potential fluctuation occurs. Although the second output stage 12 is active, since the potentials at the input nodes N13 and N14 fluctuate only slightly, the output circuit 100 does not have a sufficient capability to drive the data line load 90. That is, the second output stage 12 is substantially in the inactivation state.

On the other hand, in the second period T2, the first node N1 and the second node N2 are electrically connected, and the first output stage 11 and the second output stage 12 are activated. Among the output terminals L1 and L2 of the differential stage 10, the input node N11 (the gate of the transistor M11) and the input node N12 (the gate of the transistor M12) of the first output stage 11, and the input node N13 (gate of the transistor M13) and the input node N14 (gate of the transistor M14) of the second output stage 12, L1, N11, and N13 are electrically connected, and L2, N12, and N14 are electrically connected. Also, the third output stage 13 and the fourth output stage 14 are inactivated, and the output terminals L1 and L2 of the differential stage 10 are electrically disconnected with the input node N15 (the gate of the transistor M15) and the input node N16 (the gate of the transistor M16) of the third output stage 13, and the input node N17 (gate of the transistor M17) and the input node N18 (gate of the transistor M18) of the fourth output stage 14.

In the second period T2, the first node N1 and the second node N2 are electrically connected, and therefore, with the amplification operation of the differential stage 10, the first output stage 11, and the second output stage 12, an output voltage corresponding to the input signal Vin is output to the data line load 90 connected to the second node N2 via the output pad P2. At this time, the output circuit 100 drives the data line load 90 with a high driving capability.

Next, in the data period where the input signals VD (N+1) of the second polarity (negative polarity) voltage is applied, the switches S11, S12, S13, S14, S25, S26, S27 and S28 are turned off, and the switches S15, S16, S17, S18, S21, S22, S23 and S24 are turned on during the first period T1 and the second period T2. The output control switch S10 is turned off during the first period T1 and turned on during the second period T2.

As a result, in the first period T1, the first node N1 and the second node N2 are not electrically connected, the first output stage 11 and the second output stage 12 are inactivated (stopped), and the output terminals L1 and L2 of the differential stage 10 are not electrically connected to the input node N11 (the gate of the transistor M11) and the input node N12 (the gate of the transistor M12) of the first output stage 11, or the input node N13 (gate of the transistor M13) and the input node N14 (gate of the transistor M14) of the second output stage 12. Also, the third output stage 13 and the fourth output stage 14 are activated (in operation), and among the output terminals L1 and L2 of the differential stage 10, the input node N15 (the gate of the transistor M15) and the input node N16 (the gate of the transistor M16) of the third output stage 13, and the input node N17 (gate of the transistor M17) and the input node N18 (gate of the transistor M18) of the fourth output stage 14, L1, N15, and N17 are electrically connected, and L2, N16, and N18 are electrically connected.

In the first period T1, with the amplification operation of the differential stage 10 and the third output stage 13, an output voltage corresponding to the input signal Vin is output to the first node N1. At this time, the load of the first node N1 is the internal parasitic capacitance only. Therefore, the potential of the first node N1 can easily follow the input signal Vin, and the output terminals L1 and L2 of the differential stage 10 and the input nodes N15 and N16 of the third output stage 13 have slight potential fluctuations. Since the input nodes N17 and N18 of the fourth output stage 14 are electrically connected to the output terminals L1 and L2 of the differential stage 10, respectively, the potentials fluctuate only slightly. Although the fourth output stage 14 is active, since the potential fluctuations of the input nodes N17 and N18 are small, the output circuit 100 does not have a sufficient capability to drive the data line load 90. That is, the second output stage 14 is substantially in the inactivation state.

On the other hand, in the first period T2, the first node N1 and the second node N2 are electrically connected, the first output stage 11 and the second output stage 12 are inactivated (stopped), and the output terminals L1 and L2 of the differential stage 10 are not connected to the input node N11 (the gate of the transistor M11) and the input node N12 (the gate of the transistor M12) of the first output stage 11, or the input node N13 (gate of the transistor M13) and the input node N14 (gate of the transistor M14) of the second output stage 12. Also, the third output stage 13 and the fourth output stage 14 are activated (in operation), and among the output terminals L1 and L2 of the differential stage 10, the input node N15 (the gate of the transistor M15) and the input node N16 (the gate of the transistor M16) of the third output stage 13, and the input node N17 (gate of the transistor M17) and the input node N18 (gate of the transistor M18) of the fourth output stage 14, L1, N15, and N17 are electrically connected, and L2, N16, and N18 are electrically connected.

In the second period T2, the first node N1 and the second node N2 are electrically connected, and therefore, with the amplification operation of the differential stage 10, the third output stage 13, and the fourth output stage 14, an output voltage corresponding to the input signal Vin is output to the data line load 90 connected to the second node N2. At this time, the output circuit 100 drives the data line load 90 with a high driving capability.

The output circuit 100 of this embodiment is configured such that the first output stage 11 and the second output stage 12, which is operated by the positive polarity voltage, and the third output stage 13 and the fourth output stage 14, which is operated by the negative polarity voltage, are connected to the first node N1 and the second node N2 in parallel, and differs from a conventional output circuit (see Patent Document 1, for example) in that the power supply voltage supplied to the first output stage 11 and the second output stage 12 is different from the power supply voltage supplied to the third output stage 13 and the fourth output stage 14.

In addition, the conventional output circuit is configured such that, in one data period, the first output stage is activated and the second output stage is inactivated during the first period, and the first and second output stages are both activated during the second stage. On the other hand, the output circuit 100 of this embodiment differs from the conventional output circuit in that the first output stage 11 and the second output stage 12, or the third output stage 13 and the fourth output stage 14, are both activated at least at the end point of one data period and the second period T2.

In the output circuit 100 of this embodiment, during the data period in which the input signal Vin of the first polarity (positive polarity) is supplied, the first output stage 11 and the second output stage 12 are activated (operated) during the first period T1 and the second period T2. That is, during the first period T1 and the second period T2, the first output (output terminal L1) of the differential stage 10 is electrically connected to the input node N11 (gate of the transistor M11) of the first output stage 11 and the input node N13 (gate of the transistor M13) of the second output stage 12, and the second output (output terminal L2) of the differential stage 10 is electrically connected to the input node N12 (gate of the transistor M12) of the first output stage 11 and the input node N14 (gate of the transistor M14) of the second output stage 12.

Thus, during the first period T1, the gate potential difference between the Pch transistors M11 and M13, and the gate potential difference between the Nch transistors M12 and M14 are both 0V, which means that the capacitance coupling between the respective gates does not occur when the first period T1 is switched over to the second period T2. Therefore, if the output control switch S10 is turned on at the beginning of the second period T2, the charging operation or discharging operation for the line capacitance CL of the data line load 90 starts immediately due to the amplification operation of the first output stage 11 and the second output stage 12, which makes possible the output waveform with minimum distortion or delay.

Similarly, during the data period in which the input signal Vin of the second polarity (negative polarity) is supplied, the third output stage 13 and the fourth output stage 14 are activated (operated) during the first period T1 and the second period T2. That is, during the first period T1 and the second period T2, the first output (output terminal L1) of the differential stage 10 is electrically connected to the input node N15 (gate of the transistor M15) of the third output stage 13 and the input node N17 (gate of the transistor M17) of the fourth output stage 14, and the second output (output terminal L2) of the differential stage 10 is electrically connected to the input node N16 (gate of the transistor M16) of the third output stage 13 and the input node N18 (gate of the transistor M18) of the fourth output stage 14.

Thus, during the first period T1, the gate potential difference between the Pch transistors M15 and M17, and the gate potential difference between the Nch transistors M16 and M18 are both 0V, which means that the capacitance coupling between the respective gates does not occur when the first period T1 is switched over to the second period T2. Therefore, if the output control switch S10 is turned on at the beginning of the second period T2, the charging operation or discharging operation for the line capacitance CL of the data line load 90 starts immediately due to the amplification operation of the third output stage 13 and the fourth output stage 14, which makes possible the output waveform with minimum distortion or delay.

Embodiment 2

Figure 3:
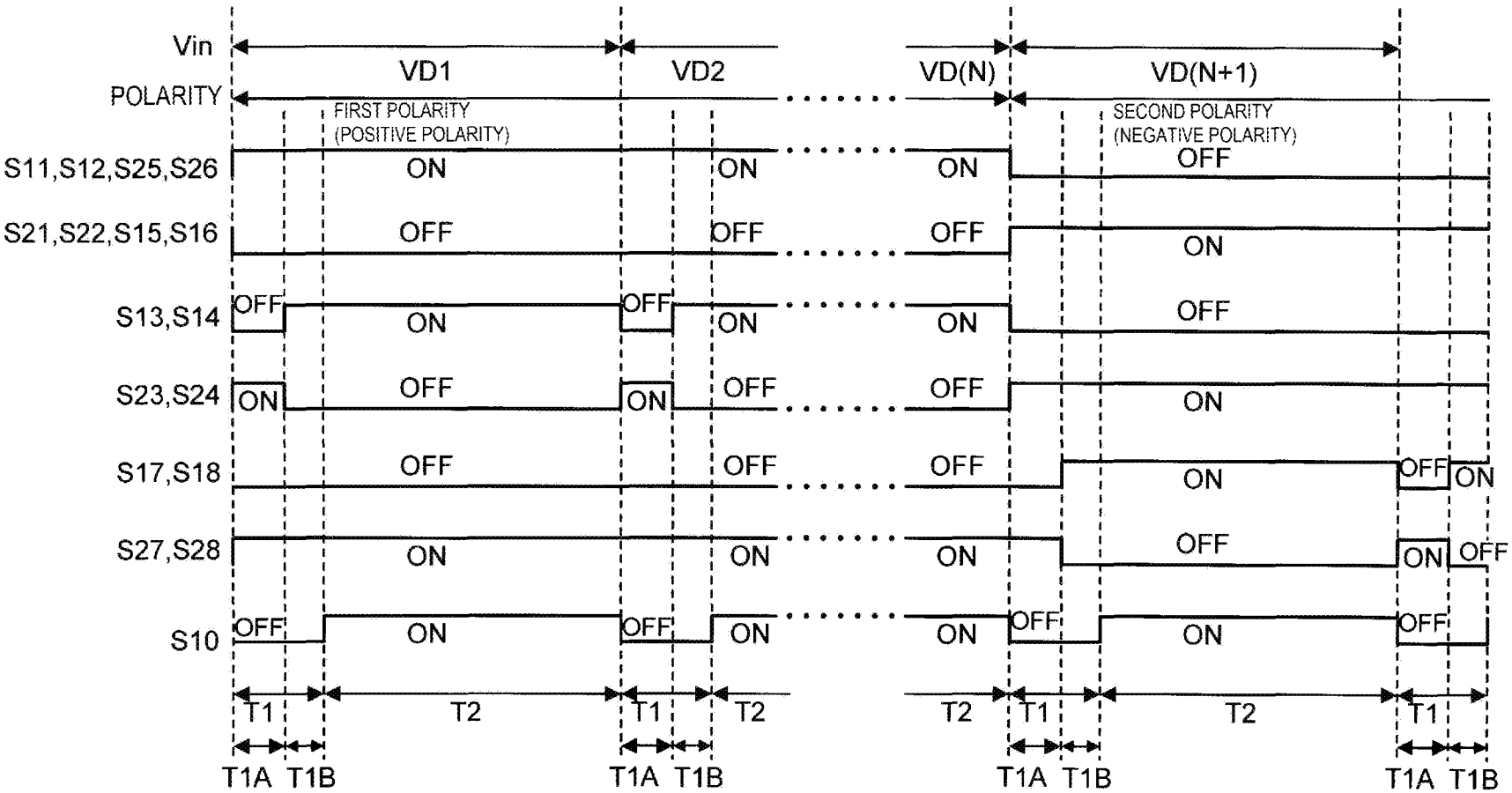
FIG. 3 is a time chart showing a connection control example in Embodiment 2.

FIG. 3 is a time chart showing a connection control example in the semiconductor device of this embodiment. Unlike Embodiment 1, the first period T1 has the first sub-period T1A and the second sub-period T1B.

In each data period that receives the input signals VD1 to VD(N) of the first polarity (positive polarity) voltage, the switches S11, S12, S25, S26, S23, S24, S27 and S28 are turned on, and the switches S21, S22, S15, S16, S13, S14, S17 and S18 are turned off during the first sub-period T 1A of the first period T1. The output control switch S10 is also turned off.

This way, during the first sub-period T1A, the first node N1 and the second node N2 are electrically disconnected, the first output stage 11 is activated (operated), the output terminal L1 of the differential stage 10 is electrically connected to the input node N12 of the first output stage 11, and the output terminal L2 of the differential stage 10 is electrically connected to the input node N12 of the first output stage 11. Also, the second output stage 12, the third output stage 13, and the fourth output stage 14 are all inactivated (stopped), and the output terminal L1 and L2 of the differential stage 10 are all electrically disconnected to the respective input nodes (N13, N14, N15, N16, N17, and N18) of the second to fourth output stages (12, 13, and 14).

In the first sub-period T1A, with the amplification operation of the differential stage 10 and the first output stage 11, an output voltage corresponding to the input signal Vin is output to the first node N1. At this time, the load of the first node N1 is the internal parasitic capacitance only. Therefore, the potential of the first node N1 can easily follow the input signal Vin, and the output terminals L1 and L2 of the differential stage 10 and the input nodes N11 and N12 of the first output stage 11 have small potential fluctuations.

During the first sub-period T1A, the input nodes N11 and N12 of the first output stage 11 and the input nodes N13 and N14 of the second output stage 12 are electrically disconnected. Thus, the potentials of the respective gates of the Pch transistors M11 and M13 differ from each other, and the potentials of the respective gates of the Nch transistors M12 and M14 differ from each other.

Next, during the second sub-period T1B of the first period T1, the switches S11, S12, S25, S26, S13, S14, S27 and S28 are turned on, and the switches S21, S22, S15, S16, S23, S24, S17 and S18 are turned off. The output control switch S10 is also turned off.

This way, during the second sub-period T1B, the first node N1 and the second node N2 remain electrically disconnected, the first output stage 11 and the second output stage 12 are activated (operated), the output terminal L1 of the differential stage 10 is electrically connected to the input node N11 of the first output stage 11 and the input node N13 of the second output stage 12, and the output terminal L2 of the differential stage 10 is electrically connected to the input node L12 of the first output stage 11 and the input node N14 of the second output stage 12. Also, the third output stage 13 and the fourth output stage 14 are inactivated (stopped), and the output terminals L1 and L2 of the differential stage 10 are electrically disconnected from the input nodes N15 and N16 of the third output stage 13 and the input nodes N17 and N18 of the fourth output stage 14.

In the second sub-period T1B, in a manner similar to the first sub-period T1A, with the amplification operation of the differential stage 10 and the first output stage 11, an output voltage corresponding to the input signal Vin is output to the first node N1. Because the internal parasitic capacitance is the only load to the first node N1, the potential of the first node N1 can easily follow the input signal Vin.

On the other hand, during the second sub-period T1B, the input nodes N13 and N14 of the second output stage 12 are electrically connected to the output terminals L1 and L2 of the differential stage 10, and the input nodes N11 and N12 of the first output stage 11, respectively. At this time, the input node N11 (gate of the Pch transistor M11) of the first output stage 11 and the input node N13 (gate of the Pch transistor M13) of the second output stage 12 are short-circuited from the state where the respective gates have different potentials, and due to the capacitance coupling between the gates, the Pch transistor M11 is temporarily turned off, and then restarted together with the Pch transistor M13.

The input node N12 (gate of the Nch transistor M12) of the first output stage 11 and the input node N14 (gate of the Nch transistor M14) of the second output stage 12 are short-circuited from the state where the respective gates have different potentials, and due to the capacitance coupling between the gates, the Nch transistor M12 is temporarily turned off, and then restarted together with the Nch transistor M14.

Therefore, at the start of the second sub-period T1B, the first output stage 11 is temporarily inactivated (stopped), and then goes back to the active (operation) state together with the second output stage 12. In the second sub-period T1B, the second output stage 12 is in the active (operation) state, but because the first node N1 and the second node N2 are not electrically connected, the output circuit 100 does not have enough capacity to drive the data line load 90.

The switch control during the first sub-period T1B is the same as the control during the first period T1 of the output period of Embodiment 1 (FIG. 2) in which an input signal of the first polarity (positive polarity) is supplied. The switch control during the second period T2, which follows the first sub-period T1B, is the same as the control during the second period T2 of the output period of Embodiment 1 in which an input signal of the first polarity (positive polarity) is supplied. The operation of the output circuit 100 of this embodiment by the switch control during the second period T2 is the same as that of Embodiment 1, and therefore, the description will be omitted.

Next, in one data period that receives the input signal VD (N+1) of the second polarity (negative polarity) voltage, the switches S11, S12, S25, S26, S13, S14, S17 and S18 are turned off, and the switches S21, S22, S15, S16, S23, S24, S27 and S28 are turned on during the first sub-period T1A of the first period T1. The output control switch S10 is also turned off.

This way, during the first sub-period T1A, the first node N1 and the second node N2 are electrically disconnected, the third output stage 13 is activated (operated), the output terminal L1 of the differential stage 10 is electrically connected to the input node N15 of the third output stage 13, and the output terminal L2 of the differential stage 10 is electrically connected to the input node N16 of the third output stage 13. Also, the first output stage 11, the second output stage 12, and the fourth output stage 14 are all inactivated (stopped), and the output terminals L1 and L2 of the differential stage 10 are all electrically disconnected from the respective input nodes (N11, N12, N13, N14, N17, and N18) of the first, second, and fourth output stages (11, 12, and 14).

In the first sub-period T1A, with the amplification operation of the differential stage 10 and the third output stage 13, an output voltage corresponding to the input signal Vin is output to the first node N1. At this time, the load of the first node N1 is the internal parasitic capacitance only. Therefore, the potential of the first node N1 can easily follow the input signal Vin, and the output terminals L1 and L2 of the differential stage 10 and the input nodes N15 and N16 of the third output stage 13 have small potential fluctuations.

During the first sub-period T1A, the input nodes N15 and N16 of the third output stage 13 and the input nodes N17 and N18 of the fourth output stage 14 are electrically disconnected. Thus, the potentials of the respective gates of the Pch transistors M15 and M17 differ from each other, and the potentials of the respective gates of the Nch transistors M16 and M18 differ from each other.

Next, during the second sub-period T1B of the first period T1, the switches S11, S12, S25, S26, S13, S14, S27 and S28 are turned off, and the switches S21, S22, S15, S16, S23, S24, S17 and S18 are turned on. The output control switch S10 is also turned off.

This way, during the second sub-period T1B, the first node N1 and the second node N2 remain electrically disconnected, the third output stage 13 and the fourth output stage 14 are activated (operated), the output terminal L1 of the differential stage 10 is electrically connected to the input node N15 of the third output stage 13 and the input node N17 of the fourth output stage 14, and the output terminal L2 of the differential stage 10 is electrically connected to the input node N16 of the third output stage 13 and the input node N18 of the fourth output stage 14. Also, the first output stage 11, and the second output stage 12 are inactivated (stopped), and the output terminal L1 and L2 of the differential stage 10 are electrically disconnected from the input nodes N11 and N12 of the first output stage 11 and the input nodes N13 and N14 of the second output stage 12.

In the second sub-period T1B, in a manner similar to the first sub-period T1A, with the amplification operation of the differential stage 10 and the third output stage 13, an output voltage corresponding to the input signal Vin is output to the first node N1. Because the internal parasitic capacitance is the only load to the first node N1, the potential of the first node N1 can easily follow the input signal Vin.

On the other hand, during the second sub-period T1B, the input nodes N17 and N18 of the fourth output stage 14 are electrically connected to the output terminals L1 and L2 of the differential stage 10, and the input nodes N15 and N16 of the third output stage 13, respectively. At this time, the input node N15 (gate of the Pch transistor M15) of the third output stage 13 and the input node N17 (gate of the Pch transistor M17) of the fourth output stage 14 are short-circuited from the state where the respective gates have different potentials, and due to the capacitance coupling between the gates, the Pch transistor M15 is temporarily turned off, and then restarted together with the Pch transistor M17.

The input node N16 (gate of the Nch transistor M16) of the third output stage 13 and the input node N18 (gate of the Nch transistor M18) of the fourth output stage 14 are short-circuited from the state where the respective gates have different potentials, and due to the capacitance coupling between the gates, the Nch transistor M16 is temporarily turned off, and then restarted together with the Nch transistor M18.

Therefore, at the start of the second sub-period T1B, the third output stage 13 is temporarily inactivated (stopped), and then goes back to the active (operation) state together with the fourth output stage 14. In the second sub-period T1B, the fourth output stage 14 is in the active (operation) state, but because the first node N1 and the second node N2 are not electrically connected, the output circuit 100 does not have enough capacity to drive the data line load 90.

The switch control during the first sub-period T1B is the same as the control during the first period T1 of the output period of Embodiment 1 (FIG. 2) in which an input signal of the second polarity (negative polarity) is supplied. The switch control during the second period T2, which follows the first sub-period T1B, is the same as the control during the second period T2 of the output period of Embodiment 1 in which an input signal of the second polarity (negative polarity) is supplied. The operation of the output circuit 100 of this embodiment by the switch control during the second period T2 is the same as that of Embodiment 1, and therefore, the description will be omitted.

As described above, in the connection control of the output circuit 100 of this embodiment, the first period T1 of one data period in which the input signal Vin of the first polarity (positive polarity) or the second polarity (negative polarity) is supplied includes the first sub-period T1A and the second sub-period T1B. In the first sub-period T1A, the first output stage 11 or the third output stage 13 is activated (operated), and the second output stage 12 and the fourth output stage 14 are both inactivated (stopped). Also, in the first sub-period T1A, because the first node N1 and the second node N2 are not electrically connected, the data line load 90 connected to the second node N2 is completely disconnected from the output circuit 100. This makes it possible to completely prevent the data line load 90 from being affected by a change in operation of the output circuit 100 such as a major change in input signal Vin.

On the other hand, in the second sub-period T1B, depending on the input signal polarity, one pair of the first and second output stages (11, 12) and the third and fourth output stages (13, 14) is activated (operated), and the other pair is inactivated (stopped). In the second sub-period T1B, because the first node N1 and the second node N2 remain electrically disconnected continuously from the first sub-period T1A, the output circuit 100 does not have enough capacity to drive the data line load 90. Even if the input signal Vin fluctuates, as long as a major change in input signal Vin is completed in the first sub-period T1A and the input signal Vin is substantially in a stable state in the second sub-period T1B, the voltage change at the second node N2 due to the operation of the second output stage 12 or the fourth output stage 14 can be sufficiently suppressed.

At the start of the second sub-period T1B, if the input signal is of the positive polarity voltage, each first input (N11, N13) of the first output stage 11 and the second output stage 12 and each second input (N12, N14) of the first output stage 11 and the second output stage 12 are short-circuited, and if the input signal is of the negative polarity voltage, each first input (N15, N17) of the third output stage 13 and the fourth output stage 14 and each second input (N16, N18) of the third output stage 13 and the fourth output stage 14 are short-circuited, which causes the capacitance coupling between the respective gates. However, because the second output stage 12 or the fourth output stage 14 is first inactivated (stopped) and then activated (operated) together with the first output stage 11 or the third output stage 13, the voltage fluctuation does not affect the second node N2.

The second sub-period T1B is switched to the second period T2 by the switch control in a manner similar to the switching between the first period T1 and the second period T2 of Embodiment 1 (FIG. 2), and therefore, gate capacitance coupling does not occur. Thus, if the output control switch S10 is turned on at the beginning of the second period T2, the charging operation or discharging operation for the line capacitance CL of the data line load 90 starts immediately due to the amplification operation of the first and second output stages (11, 12) or the third and fourth output stages (13, 14), which makes possible the output waveform with minimum distortion or delay.

Embodiment 3

Figure 4:
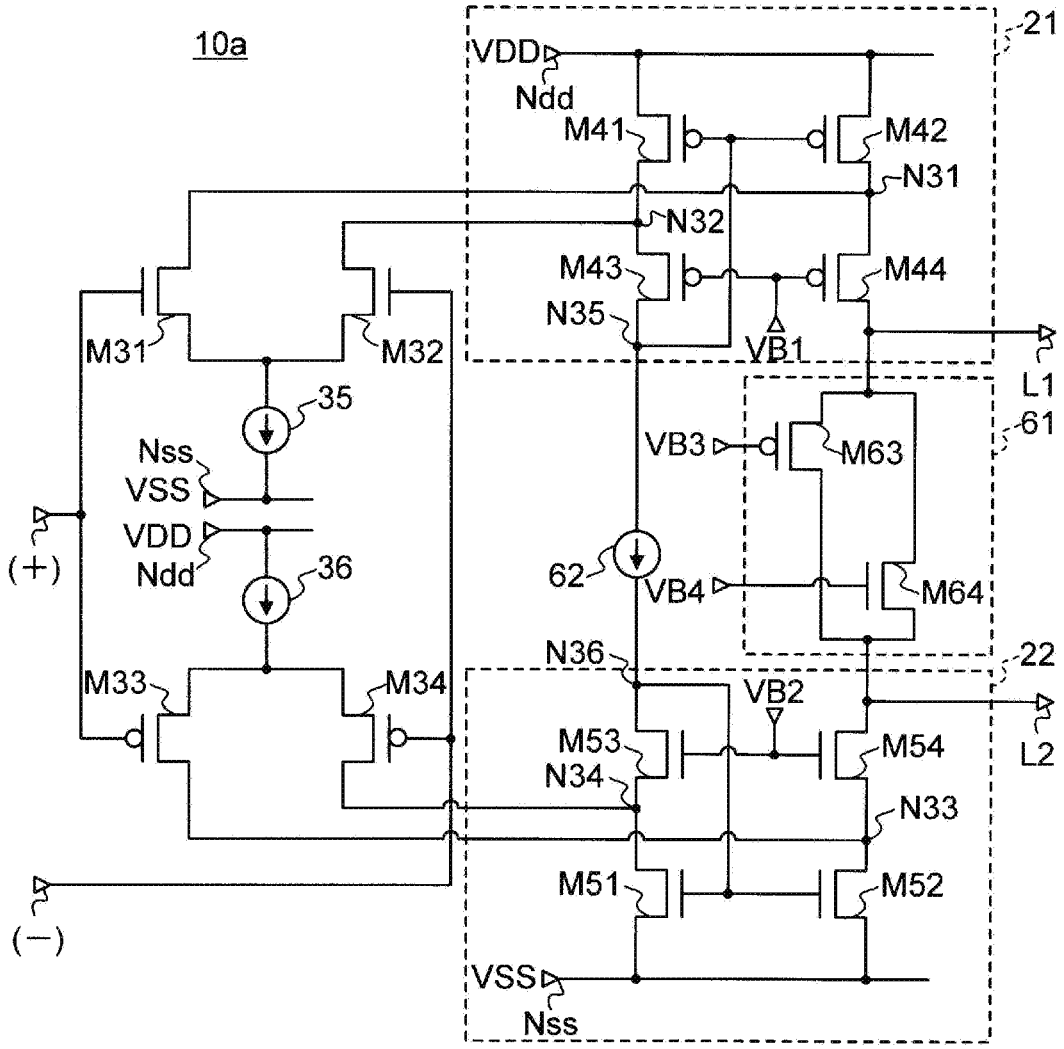
FIG. 4 is a circuit diagram showing the configuration example of a differential stage of Embodiment 3.

FIG. 4 shows a differential stage 10*a* of this embodiment, which is a configuration example of the output stage 10 in the output circuit 100 of FIG. 1.

The differential stage 10*a* includes a current source 35 having one end connected to the low-level power supply terminal Nss, an Nch differential pair (Nch transistors M31 and M32) having the common source thereof connected to the other end of the current source 35, a current source 36 having one end connected to the high-level power supply terminal Ndd, and a Pch differential pair (Pch transistors M33 and M34) having the common source thereof connected to the other end of the current source 36.

The respective gates of the Nch transistor M31 and the Pch transistor M33 (or in other words, one input of the Nch differential pair and one input of the Pch differential pair) are connected to one input terminal (+) of the input pair of the differential stage 10*a*. The respective gates of the Nch transistor M32 and the Pch transistor M34 (or in other words, the other one of the Nch differential pair and the other one of the Pch differential pair) are connected to the other input terminal (−) of the input pair of the differential stage 10*a*.

The differential stage 10*a* also includes Pch transistors M41 and M42, and Pch transistors M44 and M43. In the Pch transistors M41 and M42, the respective sources are connected to the high-level power supply terminal Ndd, and the respective gates are connected to each other. In the Pch transistors M44 and M43, the respective sources are connected to the respective drains (N31, N32) of the Pch transistors M42 and M41, and the respective gates are connected to each other and configured to receive a bias voltage VB1.

The drain of the Pch transistor M43 is commonly connected to the respective gates of the Pch transistors M42 and M41, and the drains of the Nch transistors M31 and M32, which are the output pair of the Nch differential pair, are respectively connected to the drains of the Pch transistors M42 and M41 (N31, N32). The Pch transistors M41, M42, M43, and M44 constitute a first cascode current mirror circuit 21. The drains of the Pch transistors M44 and M43 are the first terminal and the second terminal of the first cascode current mirror circuit 21.

The differential stage 10*a* also includes Nch transistors M51 and M52, and Nch transistors M54 and M53. In the Nch transistors M51 and M52, the respective sources are connected to the low-level power supply terminal Nss, and the respective gates are connected to each other. In the Nch transistors M54 and M53, the respective sources are connected to the respective drains (N33, N34) of the Nch transistors M52 and M51, and the respective gates are connected to each other and configured to receive a bias voltage VB2.

The drain of the Nch transistor M53 is commonly connected to the respective gates of the Nch transistors M52 and M51, and the drains of the Pch transistors M33 and M34, which are the output pair of the Pch differential pair, are respectively connected to the drains of the Nch transistors M52 and M51 (N33, N34). The Nch transistors M51, M52, M53, and M54 constitute a second cascode current mirror circuit 22. The drains of the Nch transistors M54 and M53 are the first terminal and the second terminal of the second cascode current mirror circuit 22.

The respective first terminals of the first and second cascode current mirror circuits (21, 22) are output terminals L1 and L2 that form the output pair of the differential stage 10*a*.

The differential stage 10*a* further includes a first floating current source 61 connected between the first terminal of the first cascode current mirror circuit 21 and the first terminal of the second cascode current mirror circuit 22, and a second floating current source 62 connected between the second terminal (N35) of the first cascode current mirror circuit 21 and the second terminal (N36) of the second cascode current mirror circuit 22.

The first floating current source 61 includes a Pch transistor M63 connected between the respective first terminals of the first cascode current mirror circuit 21 and the second cascode current mirror circuit 22 and configured to receive a bias voltage VB3 at the gate thereof, and an Nch transistor M64 also connected between the respective first terminals of the first cascode current mirror circuit 21 and the second cascode current mirror circuit 22 and configured to receive a bias voltage VB4 at the gate thereof.

One input terminal (+) of the input pair of the differential stage 10*a* is configured to receive the first polarity (positive polarity) voltage or the second polarity (negative polarity) voltage as the input signal Vin of the input terminal P1 in the configuration of the output circuit 100 of FIG. 1. The other input terminal (−) of the input pair of the differential stage 10*a* is configured to receive a voltage signal of the first node N1 in the configuration of the output circuit 100 of FIG. 1. The bias voltages VB3 and VB4, which are the bias voltages corresponding to the polarity of the input signal Vin, are supplied to the gates of the Pch transistor M63 and the Nch transistor M64 of the first floating current source 61. In the differential stage 10*a*, if the input signal Vin changes with respect to the potential of the first node N1, the potentials of the first and second output terminals L1 and L2, which form the output pair of the differential stage 10*a*, act in a direction opposite to the voltage change of the input signal Vin, respectively.

Although not shown in FIG. 4, in order to stabilize the output of the amplification operation, the output circuit 100 of FIG. 1 may also include a phase compensation capacitance connected between the first node N1 of the output circuit 100 and an appropriate terminal of the differential stage 10*a*.

Embodiment 4

Figure 5:
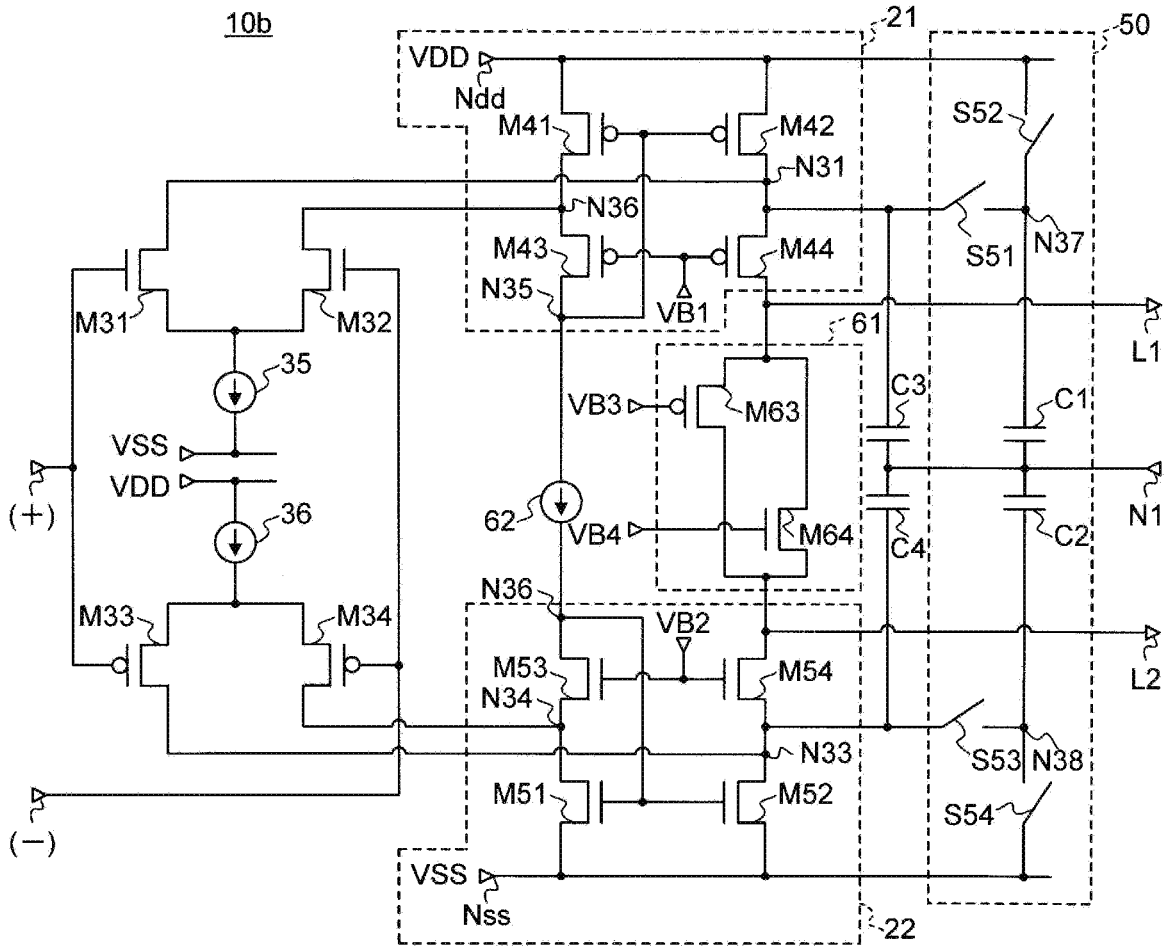
FIG. 5 is a circuit diagram showing the configuration example of a differential stage of Embodiment 4.

FIG. 5 shows a differential stage 10*b* of this embodiment, which is a configuration example of the output stage 10 in the output circuit 100 of FIG. 1. The descriptions of the same configurations as those of the differential stage 10*a* of Embodiment 3 will not be repeated.

The differential stage 10*b* differs from the differential stage 10*a* (FIG. 4) in having the first capacitance element C1, the second capacitance element C2, the third capacitance element C3, and the fourth capacitance element C4 having respective one ends connected to the first node N1 of the output circuit 100 of FIG. 1.

The differential stage 10*b* also includes a switch S51 (the seventeenth switch) connected between the other end N37 of the first capacitance element C1 and one connection point (N31) of the pair of the connection points connecting the output pair of the Nch differential pair (M31, M32) and the first cascode current mirror circuit 21, a switch S52 (the eighteenth switch) connected between the other end N37 of the first capacitance element C1 and the high-level power supply terminal Ndd, a switch S53 (the nineteenth switch) connected between the other end N38 of the second capacitance element C2 and one connection point (N33) of the pair of the connection points connecting the output pair of the Pch differential pair (M33, M34) and the second cascode current mirror circuit 22.

The other end of the third capacitance element C3 is connected to one connection point of the pair of the connection points connecting the output pair of the Nch differential pair (M31, M32) and the first cascode current mirror circuit 21. The other end of the fourth capacitance element C4 is connected to one connection point of the pair of the connection points connecting the output pair of the Pch differential pair (M33, M34) and the second cascode current mirror circuit 22.

The first and second capacitance elements (C1, C2) and the switches S51, S52, S53, and S54 controlling the connection thereof constitute a capacitance connection control circuit 50.

Next, the operation of the switch control in the output circuit 100 of FIG. 1 having the differential stage 10*b* of this embodiment will be explained with reference to the time chart of FIG. 6. The switch control of the differential stage 10*b* is performed in parallel with the connection control of the output circuit 100 shown in FIG. 2.

In each of the data period during which the input signals VD1 to VD (N) of the first polarity (positive polarity) voltage is supplied and the data period during which the input signal VD (N+1) of the second polarity (negative polarity) voltage is supplied, the switches S51 and S53 are both turned on and the switches S52 and S54 are both turned off during the first period T1.

Thus, during the first period T1, the first capacitance element C1 and the second capacitance element C2 are respectively connected in parallel to the third capacitance element C3 and the fourth capacitance element C4 that are constantly connected to each other. This increases a phase margin of the amplification operation of the output circuit 100 with respect to the first node N1, and as a result, the oscillation of the potential of the first node N1 that has the internal parasitic capacitance as the only load thereof during the first period T1 is suppressed.

On the other hand, during the second period T2, the switches S51 and S53 are both turned off, and the switches S52 and S54 are both turned on.

Thus, during the second period T2, the other end of the first capacitance element C1 is disconnected from the other end of the third capacitance element C3, and connected to the high-level power supply terminal Ndd, and the other end of the second capacitance element C2 is disconnected from the other end of the fourth capacitance element C4, and connected to the low-level power supply terminal Nss. This causes the first node N1 and the second node N2 to be electrically connected to each other during the second period T2, and in the amplification operation of the output circuit 100 for the data line load 90, only the third capacitance element C3 and the fourth capacitance element C4 act as the phase compensation capacitance.

Figure 6:
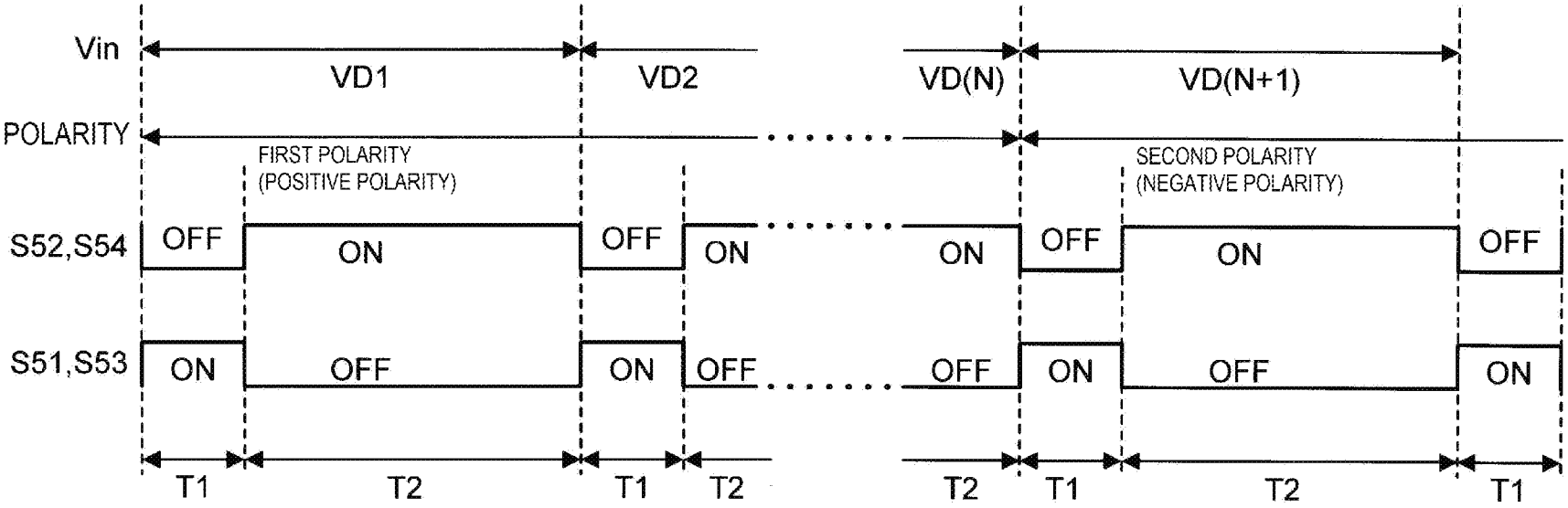
FIG. 6 is a time chart showing a control example for each switch in the differential stage of Embodiment 4.

As described above, by performing the switch control (connection control) shown in FIGS. 2 and 6, the output circuit 100 equipped with the differential stage 10*b* of this embodiment can stabilize the potential of the first node N1 during the first period T1, and drive the data line load 90 with the output waveform with less noise and the like at the beginning of the second period T2.

Embodiment 5

Figure 7:
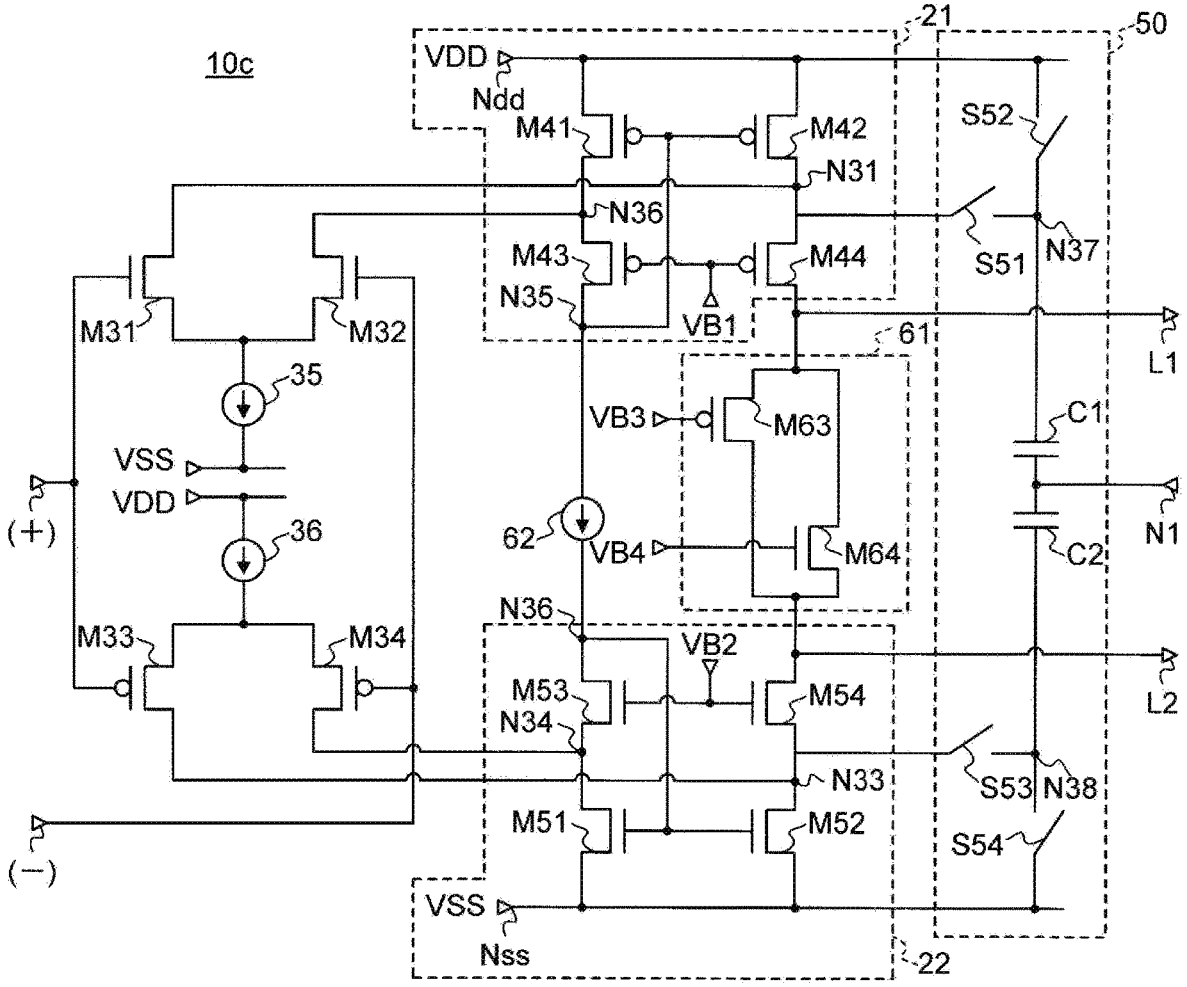
FIG. 7 is a circuit diagram showing a configuration example of a differential stage of Embodiment 5.

FIG. 7 shows a differential stage 10*c* of this embodiment, which is a configuration example of the output stage 10 in the output circuit 100 of FIG. 1. The descriptions of the same configurations as those of the differential stage 10*a* of Embodiment 3 and the differential stage 10*b* of Embodiment 4 will not be repeated.

The differential stage 10*c* differs from the differential stage 10*b* (FIG. 5) of Embodiment 4 in not having the third capacitance element C3 and the fourth capacitance element C4. The configuration of the capacitance connection control circuit 50 is the same as that of the differential stage 10*b* of Embodiment 4.

Figure 8:
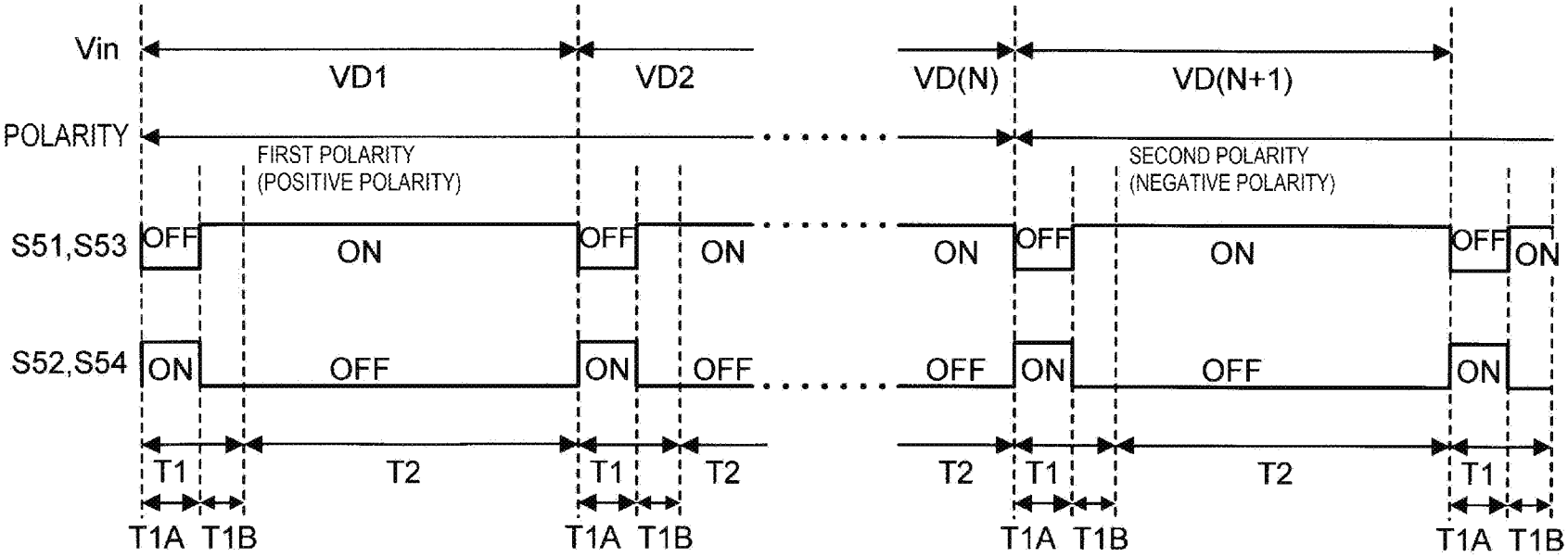
FIG. 8 is a time chart showing a control example for each switch in the differential stage of Embodiment 5.

Next, the operation of the switch control in the output circuit 100 of FIG. 1 having the differential stage 10*c* of this embodiment will be explained with reference to the time chart of FIG. 8. The switch control of the differential stage 10*c* is performed in parallel with the connection control of the output circuit 100 shown in FIG. 3.

In each of the data period during which the input signals VD1 to VD (N) of the first polarity (positive polarity) voltage is supplied and the data period during which the input signal VD (N+1) of the second polarity (negative polarity) voltage is supplied, the switches S51 and S53 are both turned off and the switches S52 and S54 are both turned on during the first sub-period T1A of the first period T1.

Because the first capacitance element C1 is connected between the first node N1 and the high-level power supply terminal Ndd, and the second capacitance element C2 is connected between the first node N1 and the low-level power supply terminal Nss, the first capacitance element C1 and the second capacitance element C2 act as the load of the first node N1 instead of the phase compensation capacitance during the first sub-period T1A. As a result, during the first sub-period T1A, the phase compensation capacitance of the differential stage 10*c* is temporarily reduced, and the output circuit 100 rapidly discharges or charges the first capacitance element C1 and the second capacitance element C2 to a level near the target gradation voltage, depending on the change in input signal Vin. Thus, the first sub-period T1A can be a relatively short period of time.

Because the phase compensation capacitance of the differential stage 10*c* is temporarily reduced during the first sub-period T1A, the potential of the first node N1 is unstable, but it would not pose a problem as long as the first capacitance element C1 and the second capacitance element C2 are rapidly charged or discharged to a level near the target gradation voltage.

On the other hand, during the second sub-period T1B of the first period T1 and the second period T2, the switches S51 and S53 are both turned on, and the switches S52 and S54 are both turned off.

Thus, the first capacitance element C1 is connected between the first node N1 and one connection point (N31) of the pair of the connection points connecting the output pair of the Nch differential pair (M31, M32) and the first cascode current mirror circuit 21. The second capacitance element C2 is connected between the first node N1 and the other connection point (N33) of the pair of the connection points connecting the output pair of the Pch differential pair (M33, M34) and the second cascode current mirror circuit 22. Thus, from the second sub-period T1B, the first capacitance element C1 and the second capacitance element C2 start acting as the phase compensation capacitance.

The potential of one connection point (N31) of the pair of the connection points connecting the output pair of the Nch differential pair (M31, M32) and the first cascode current mirror circuit 21 is sufficiently close to the high-level power supply voltage VDD, and the potential of one connection point (N33) of the pair of the connection points connecting the output pair of the Pch differential pair (M33, M34) and the second cascode current mirror circuit 22 is sufficiently close to the low-level power supply voltage VSS. Thus, the electrical charges discharged from or charged to the first capacitance element C1 and the second capacitance element C2 during the first sub-period T1A can be used during the second sub-period T1B.

During the second sub-period T1B, the output circuit 100 drives the first node N1 to the target gradation voltage by performing the amplification operation on the first capacitance element C1 and the second capacitance element C2 discharged or charged to a level near the target gradation voltage so as to make up for the insufficient charges. Thus, the second sub-period T1B can also be a relatively short period of time.

As described above, by performing the switch control (connection control) shown in FIGS. 2 and 6, the output circuit 100 equipped with the differential stage 10*c* of this embodiment rapidly charges or discharges the first node N1 and the first capacitance element C1 and the second capacitance element C2, which are the load of the first node N1, to a level near the target gradation voltage in the first sub-period TlA of the first period T1, and then in the second sub-period T1B switches the connection of the first capacitance element C1 and the second capacitance element C2 for the phase compensation so that the insufficient changes are made up for.

This makes it possible to minimize the length of the first sub-period T1A and the second sub-period T1B, and to make the second period T2, during which the data line load 90 is actually driven, longer compared to the output circuit 100 equipped with the differential stage 10*a* of Embodiment 3. That is, the driving of the data line load 90 in one data period can start sooner, which allows for high-speed driving.

Embodiment 6

Figure 9:
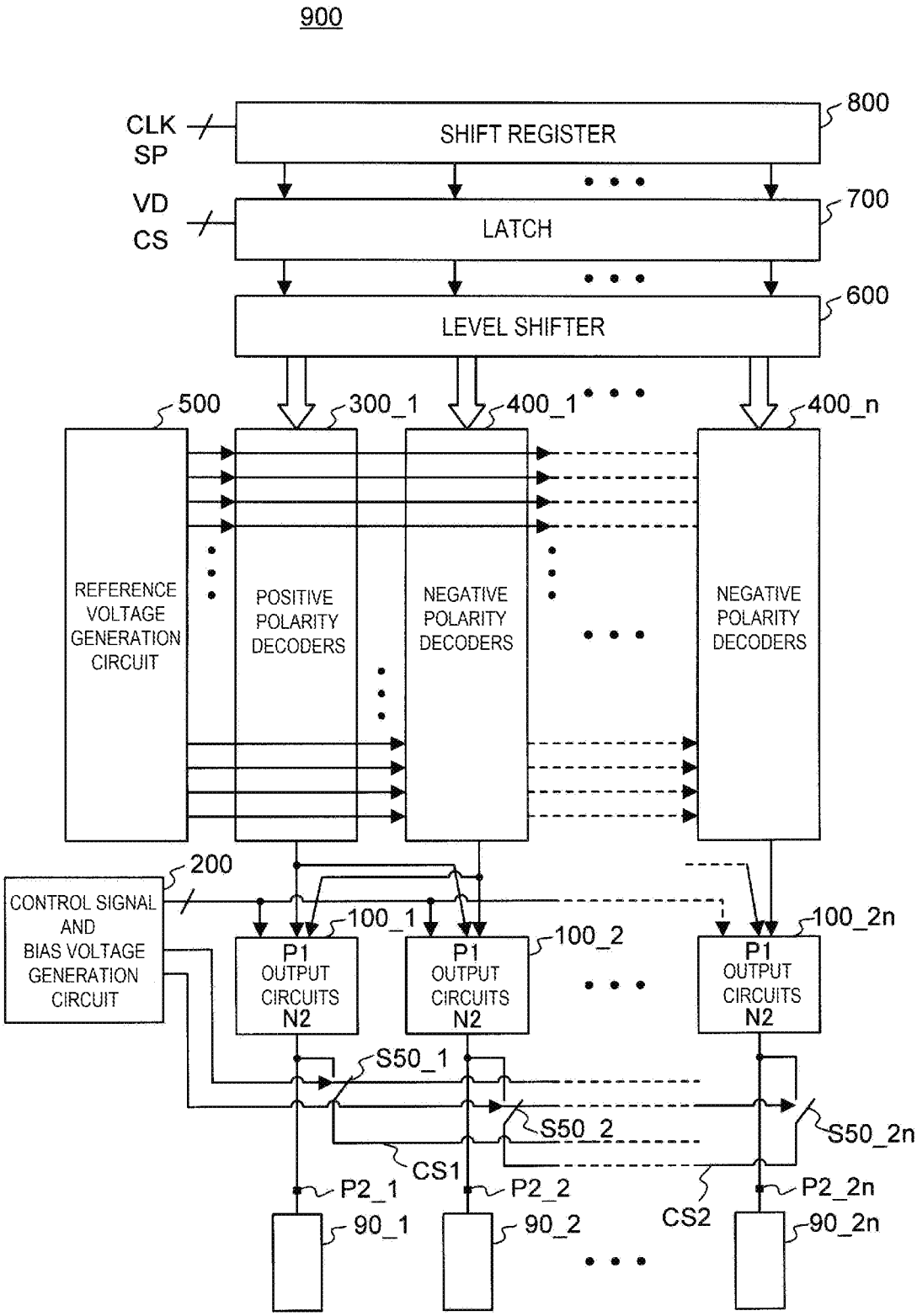
FIG. 9 is a diagram showing a configuration example when the output circuit of the present invention is used for a data driver.

FIG. 9 is a block diagram showing the configuration of a data driver 900 of this embodiment, which is an example of a data driver equipped with the output circuit 100 of FIG. 1. Below, an example in which the output number of the data driver 900 is 2n (n=natural number) will be explained.

The data driver 900 includes output circuits 100_1 to 100_2*n*, a control signal and bias voltage generation circuit 200, cathode decoders 300_1 to 300_*n*, anode decoders 400_1 to 400_*n*, a reference voltage generation circuit 500, a level shifter 600, a latch 700, and a shift register 800.

The data driver 900 also includes output pads P2_1 to P2_2*n*, charge sharing wiring lines CS1 and CS2, and charge sharing switches S50_1 to S50_2*n*. Data line loads 90_1 to 90_2*n* are connected to the output pads P2_1 to P2_2*n*.

Each of the output circuits 100_1 to 100_2*n* has the same configuration as that of the output circuit 100 of FIG. 1. The differential stage 10 of the output circuits 100_1 to 100_2*n* has the same configuration as one of FIG. 4, FIG. 5, and FIG. 7 (that is, one of the differential stage 10*a*, 10*b*, and 10*c*).

The shift register 800 determines the timing of the data latch based on the clock signal CLK and the start pulse SP.

The latch 700 latches the digital image data VD based on the timing determined by the shift register 800, and sends the image data VD to the level shifter 600 according to the timing of the control signal CS.

The level shifter 600 amplitude-extends the image data VD, and supplies the data to the positive polarity decoders 300_1 to 300_*n* or the negative polarity decoders 400_1 to 400_*n* depending on the polarity.

The reference voltage generation circuit 500 commonly supplies a plurality of positive polarity reference voltages to the positive polarity decoders 300_1 to 300_ *n*, and commonly supplies a plurality of negative polarity reference voltages to the negative polarity decoders 400_1 to 400_*n*.

The positive polarity decoders 300_1 to 300_*n* and the negative polarity decoders 400_1 to 400_*n* are alternately arranged corresponding to the output of the data driver 900, for example, and constitute 2*n* decoders as a whole. Each of the positive polarity decoders 300_1 to 300_*n* and the negative polarity decoders 400_1 to 400_*n* selects a reference voltage corresponding to the image data VD (amplitude-expanded image data VD) supplied from the level shifter 600. Each of the positive polarity decoders 300_1 to 300_*n* and the negative polarity decoders 400_1 to 400_*n* supplies the selected reference voltage as an input signal corresponding to the output polarity to the corresponding output circuits 100_1 to 100_2*n*.

The control signal and bias voltage generation circuit 200 supplies a switching control signal for controlling a switching operation of each switch in the output circuits 100_1 to 100_2*n* and each bias voltage for the output circuits 100_1 to 100_2*n* to the output circuits 100_1 to 100_2*n*.

In accordance with the switching control signal from the control signal and bias voltage generation circuit 200, the output circuits 100_1 to 100_2*n* perform control according to the time charts shown in FIGS. 2, 3, 6, and 8, thereby outputting a gradation voltage signal in accordance with the input signal to the corresponding data line loads 90_1 to 90_2*n* in each data period.

As a result, the data driver 900 can achieve an output waveform in which the distortion and the output delay are suppressed in driving the data line loads 90_1 to 90_2*n* connected to the respective outputs, which allows for high quality display in a liquid crystal display panel.

The shift register 800 and the latch 700 are logic circuits, which are generally operated by a low-voltage power source, and are configured to receive voltages VSS and VCC (VSS=0V, VCC=1.8 to 3.3V, for example). The respective circuits after the level shifter 600 are generally operated by a high-voltage power source, and configured to receive voltages VSS, VDM, and VDD (VSS=0V, VDD=10 to 20V, VDMVDD/2, for example).

In the data driver 900 of this embodiment, in order to reduce the power consumption, charge sharing wiring lines CS1 and CS2 and charge sharing switches S50_1 to S50_2*n* are provided. In recent years, the data line load (especially the load capacity) has greatly increased due to the large screen of the display panel, which has caused problems such as an increase in power consumption of the data driver and the resultant high heat generation. The charge sharing driving is one of the effective methods to mitigate heat generation by reusing part of the discharged or charged electrical charges of the data line load capacitance.

The charge sharing wiring lines CS1 and CS2 are provided for each output polarity. For example, if the polarity of the gradation voltage to be output to the data line differs between the odd-numbered and even-numbered data lines, the odd-numbered output circuits output a positive polarity gradation voltage, and the even-numbered output circuits output a negative polarity gradation voltage in one frame period. Thus, the charge share wiring lines CS1 is connected to the output terminals (N2) of the odd-numbered output circuits via switches S50_1, S50_ 3, . . . , S50_2*n*-1. Similarly, the charge sharing wiring line CS2 is connected to the output terminals (N2) of the even-numbered output circuits via switches S50_2, S50_ 4, . . . , S50_2*n*. The charge sharing wiring lines CS 1 and CS 2 may each have a large capacitance element connected between the charge sharing wiring lines CS1 and CS2 and a prescribed power supply terminal.

It is preferable that the charge sharing control be conducted during the first period T1 of each data period in the time charts of FIGS. 2, 3, 6, and 8. For example, by configuring the charge sharing switches S50_1 to S50_2*n* so as to be on during the first period T1 and off during the second period T2, the respective data line loads to be driven by the positive polarity voltage are electrically connected via the charge sharing wiring line CS1 during the first period T1, and the positive polarity voltages of the respective data line loads driven in the previous data period are averaged out. Similarly, the respective data line loads to be driven by the negative polarity voltage are electrically connected via the charge sharing wiring line CS2, and the negative polarity voltages of the respective data line loads driven in the previous data period are averaged out.

Therefore, if the potential of the gradation voltage output from the output circuit during one data period largely differs from the potential of the gradation voltage output from the output circuit during the next data period, the output circuit only needs to be driven to make up for the difference between the averaged voltage and the target gradation voltage during the second period T2. This makes it possible to reduce the power consumption of the data driver. The reduction in power consumption due to the charge sharing driving depends on the display pattern, and therefore, it is preferable to decide whether the charge sharing driving needs to be conducted or not depending on the display pattern.

Figure 10:
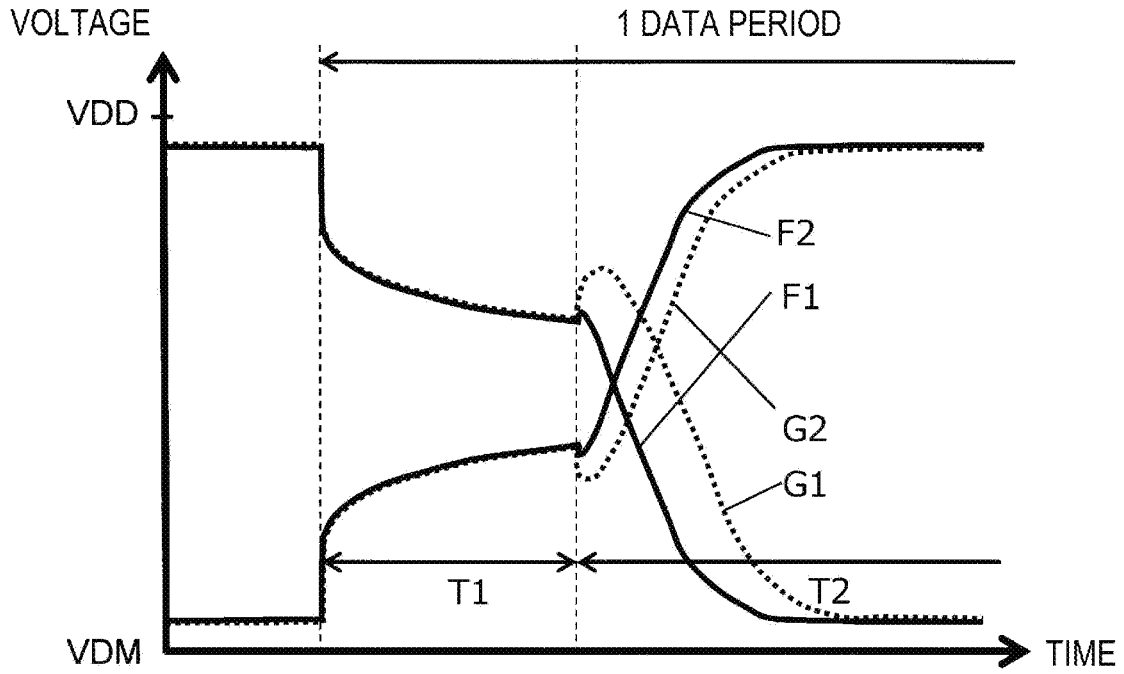
FIG. 10 is a time chart showing an output waveform when the output circuit of the present invention is used for a data driver.

FIG. 10 is a diagram showing the output voltage waveform at the near end of the data line when the positive polarity voltage is output to drive the data line load in the data driver 900 of an embodiment of the present invention in comparison with the output voltage waveform at the near end of the data line in the data driver of a comparison example. The comparison example shows the output voltage waveform in a case where the output circuit is operated as a positive polarity driving amplifier for the column inversion driving and the positive polarity voltage is output to drive the data line in the conventional data driver (for example, the data driver of Patent Document 1) that does not include an output circuit having the configuration of FIG. 1, unlike the data driver 900 of an embodiment of the present invention. In both of an embodiment of the present invention and the comparison example, one data period has the first period T1 and the second period T2, and the charge sharing driving is performed in the first period T1.

The waveform G1 (dotted line) shows the waveform of the data period in which the discharging operation is performed to bring the gradation voltage from a level near the high-level power supply voltage VDD to a level near the mid-level power supply voltage VDM in the output voltage waveform of the comparison example. The waveform G2 (dotted line) shows the waveform of the data period in which the charging operation is performed to bring the gradation voltage from a level near the mid-level power supply voltage VDM to a level near the high-level power supply voltage VDD in the output voltage waveform of the comparison example.

The waveform F1 (solid line) shows the waveform of the data period in which the discharging operation is performed to bring the gradation voltage down to the mid-level power supply voltage VDM in the output voltage waveform of an embodiment of the present invention. The waveform F2 (solid line) shows the waveform of the data period in which the charging operation is performed to bring the gradation voltage up to the high-level power supply voltage VDD in the output voltage waveform of an embodiment of the present invention.

In the waveforms G1 and G2, which are the output voltage waveforms of the comparison example, the potentials of the waveforms G1 and G2 change toward the intermediate level between the high-level power supply voltage VDD and the mid-level power supply voltage VDM by the charge sharing driving in the first period T1. During the first period T1, the positive polarity driving amplifier of the data driver of the comparison example is configured such that the first output stage is activated (operated), and the second output stage is inactivated (stopped). In the second period T2, both the first output stage and the second output stage are activated (operated), but at the beginning of the second period T2, the transistors of the first output stage and the second output stage are temporarily turned off due to the capacitance coupling between the respective gates of the output transistors constituting each output stage, which prevents the data line load to be charged or discharged immediately after the second period T2 starts. While the transistors of the first output stage and the second output stage are temporarily turned off at the beginning of the second period T2, the potentials of the waveforms G1 and G2 at the near end of the data line load have distortion by being pulled toward the potentials at the far end of the data line load. When the transistors of the first output stage and the second output stage are switched from off to on, the potentials of the waveforms G1 and G2 change toward the respective target gradation voltages.

In the waveform G1, waveform distortion and output delay occur due to the capacitance coupling between the respective gates of the Nch transistors of the first output stage and the second output stage. Because the potential difference between the respective gates of the Nch transistors during the first period T1 is larger due to the back bias voltage, the off period at the beginning of the second period T2 is longer, and the waveform distortion and the output delay are greater. In the waveform G2, waveform distortion and output delay occur due to the capacitance coupling between the respective gates of the Pch transistors of the first output stage and the second output stage. Although the Pch transistors are not affected by the back bias voltage, the respective gates still have a potential difference that is equivalent to the threshold voltage during the first period T1, and therefore, the off period at the beginning of the second period T2 still exists, which causes small waveform distortion and output delay. Such waveform distortion and output delay, and the asymmetry between the waveforms G1 and G2 cause the degradation of display quality.

On the other hand, in the waveforms F1 and F2, which are the output voltage waveforms of an embodiment of the present invention, the potentials of the waveforms F1 and F2 change toward the intermediate level between the high-level power supply voltage VDD and the mid-level power supply voltage VDM by the charge sharing driving in the first period T1 in a manner similar to the waveforms G1 and G2. The output circuit (when the positive polarity voltage is input) of the data driver 900 of an embodiment of the present invention is configured such that the first output stage and the second output stage are both activated (operated) at the end of the first period T1, and the first output stage and the second output stage continue to be activated (operated) during the second period T2. Thus, the capacitance coupling between the respective gates does not occur at the beginning of the second period T2, and the data line load is driven immediately after the start of the second period T2. The waveforms F1 and F2 have little waveform distortion and output delay, and therefore, the discharge waveform (F1) and the charge waveform (F2) are symmetric. As a result, high quality display is achieved.

The present invention is not limited to the respective embodiments above. For example, the connection configuration of the respective switches of the output circuit 100 is not limited to those described in each embodiment above, and any connection configuration can be employed as long as the first output stage 11, the second output stage 12, the third output stage 13, and the fourth output stage 14 can be appropriately activated and inactivated.

In the respective embodiments above, the data line load 90 was constituted of one stage of line resistance RL and line capacitance CL, but the data line load 90 may also be constituted of a plurality of stages of resistance and capacitance.

In the time chart of FIG. 2, a prescribed blanking period may be inserted between the N-th data period and the (N+1)-th data period when the polarity is switched. In the blanking period, it is preferable that the first output stage 11, the second output stage 12, the third output stage 13, and the fourth output stage 14 of the output circuit 100 be all inactivated, and the output control switch S10 be not electrically conducted.

What is claimed is:

1. A semiconductor device for driving a load of an object, comprising:

a driving output terminal connected to the load;

a high-level power supply terminal that receives a high-level power supply potential;

a low-level power supply terminal that receives a low-level power supply potential;

a mid-level power supply terminal that receive a mid-level power supply potential that is in between the high-level power supply potential and the low-level power supply potential;

a differential circuit having a first input configured to receive an input signal, a second input, and a pair of outputs configured to output differential output signals generated by the differential circuit;

a first output circuit connected between the high-level power supply terminal and the mid-level power supply terminal, and being configured to receive the differential output signals from the differential circuit, generate a first output signal, and output the first output signal to be inputted to the second input of the differential circuit;

a second output circuit connected between the high-level power supply terminal and the mid-level power supply terminal, the second output circuit being configured to receive the differential output signals from the differential circuit, generate a second output signal, and output the second output signal to be outputted through the driving output terminal;

a third output circuit connected between the mid-level power supply terminal and the low-level power supply terminal, the third output circuit being configured to receive the differential output signals from the differential circuit, generate a third output signal, and output the third output signal to be inputted to the second input of the differential circuit;

a fourth output circuit connected between the mid-level power supply terminal and the low-level power supply terminal, the fourth output circuit being configured to receive the differential output signals from the differential circuit, generate a fourth output signal, and output the fourth output signal to be outputted through the driving output terminal;

an output control switch connected between the second input of the differential circuit and the driving output terminal; and a control circuit configured to respectively connect or disconnect the differential circuit to each of the first to fourth circuits and connect or disconnect the second input of the differential circuit to the driving output terminal.

2. The semiconductor device according to claim 1, wherein the input signal is of a first polarity voltage or a second polarity voltage, wherein one data period in which the load is driven upon receiving the input signal includes a first period that starts from a beginning of said one data period and a second period that starts after the first period, wherein the control circuit is configured such that:

in the first period of the one data period during which the input signal is of the first polarity voltage, the second input of the differential circuit and the driving output terminal are electrically disconnected, the first output circuit is activated, the differential output signals are inputted to the first output circuit, and the third output circuit and the fourth output circuit are both inactivated, and no differential output signal from the differential circuit is inputted to each of the third output circuit and the fourth output circuit, at the end of the first period, the second output circuit is activated, and the differential output signals are inputted to the second output circuit;

in the second period of the one data period during which the input signal is of the first polarity voltage, the second input of the differential circuit and the driving output terminal are electrically connected, the first output circuit and the second output circuit are both activated, the differential output signals are inputted to each of the first output circuit and the second output circuit, the third output circuit and the fourth output circuit are both inactivated, and no differential output signal from the differential circuit is inputted to each of the third output circuit and the fourth output circuit during the second period, in the first period of another one data period during which the input signal is of the second polarity voltage, the second input of the differential circuit and the driving output terminal are electrically disconnected, the third output circuit is activated, the differential output signals are inputted to the third output circuit, the first output circuit and the second output circuit are both inactivated, and no differential output signal from the differential circuit is inputted to each of the first output circuit and the second output circuit, at the end of the first period, the fourth output circuit is activated, and the differential output signals are inputted to the fourth output circuit, and in the second period of the other one data period during which the input signal is of the second polarity voltage, the second input of the differential circuit and the driving output terminal are electrically connected, the third output circuit and the fourth output circuit are both activated, the differential output signals are inputted to each of the third output circuit and the fourth output circuit, the first output circuit and the second output circuit are both inactivated, and no differential output signal from the differential circuit is inputted to each of the first output circuit and the second output circuit during the second period.

3. The semiconductor device according to claim 2, wherein the control circuit is configured such that:

in the first period of the one data period during which the input signal is of the first polarity voltage, the second output circuit is activated, and the differential output signals are inputted to the second output circuit, and in the first period of the one data period during which the input signal is of the second polarity voltage, the fourth output circuit is activated, and the differential output signals are inputted to the fourth output circuit.

4. The semiconductor device according to claim 2, wherein each first period includes a first sub-period that starts at a beginning of the first period, and a second sub-period that starts after the first sub-period, and wherein the control circuit is configured such that:

in the first sub-period of the one data period during which the input signal is of the first polarity voltage, the second output circuit is inactivated, and no differential output signal from the differential circuit is inputted to the second output circuit, in the second sub-period of the one data period during which the input signal is of the first polarity voltage, the second output circuit is activated, and the differential output signals are inputted to the second output circuit, in the first sub-period of the other one data period during which the input signal is of the second polarity voltage, the fourth output circuit is inactivated, and no differential output signal from the differential circuit is inputted to the fourth output circuit, and in the second sub-period of the other one data period during which the input signal is of the second polarity voltage, the fourth output circuit is activated, and the differential output signals are inputted to the fourth output circuit.

5. The semiconductor device according to claim 4, wherein the first output circuit includes a first transistor of a first conductivity type connected between the high-level power supply terminal and the second input of the differential circuit, and a second transistor of a second conductivity type that is opposite to the first conductivity type, the second transistor being connected between the second input of the differential circuit and the mid-level power supply terminal, wherein the second output circuit includes a third transistor of the first conductivity type connected between the high-level power supply terminal and the driving output terminal, and a fourth transistor of the second conductivity type connected between the driving output terminal and the mid-level power supply terminal, wherein the third output circuit includes a fifth transistor of the first conductivity type connected between the mid-level power supply terminal and the second input of the differential circuit, and a sixth transistor of the second conductivity type connected between the second input of the differential circuit and the low-level power supply terminal, wherein the fourth output circuit includes a seventh transistor of the first conductivity type connected between the mid-level power supply terminal and the driving output terminal, and an eighth transistor of the second conductivity type connected between the driving output terminal and the low-level power supply terminal, wherein the control circuit comprises:

the output control switch connected between the second input of the differential circuit and the driving output terminal;

first, third, fifth, and seventh switches connected between a control terminal of each of the first, third, fifth, and seventh transistors and one of the pair of outputs of the differential circuit;

second, fourth, sixth, and eighth switches connected between a control terminal of each of the second, fourth, sixth, and eighth transistors and another one of the pair of outputs of the differential circuit;

ninth and eleventh switches connected between the control terminal of each of the first and third transistors and the high-level power supply terminal;

tenth, twelfth, thirteenth, and fifteenth switches connected between the control terminal of each of the second, fourth, fifth, and seventh transistors and the mid-level power supply terminal; and fourteenth and sixteenth switches connected between the control terminal of each of the sixth and eighth transistors and the low-level power supply terminal.

6. The semiconductor device according to claim 5, wherein the control circuit is configured such that:

during the first period of the one data period during which the input signal is of the first polarity voltage, the first, second, third, fourth, thirteenth, fourteenth, fifteenth and sixteenth switches are turned on, and the fifth, sixth, seventh, eighth, ninth, tenth, eleventh, and twelfth switches and the output control switch are turned off, during the second period of the one data period during which the input signal is of the first polarity voltage, the first, second, third, fourth, thirteenth, fourteenth, fifteenth and sixteenth switches and the output control switch are turned on, and the fifth, sixth, seventh, eighth, ninth, tenth, eleventh, and twelfth switches are turned off during the second period, and during the first period of the one data period during which the input signal is of the second polarity voltage, the first, second, third, fourth, thirteenth, fourteenth, fifteenth and sixteenth switches and the output control switch are turned off, and the fifth, sixth, seventh, eighth, ninth, tenth, eleventh, and twelfth switches are turned on during the first period, and during the second period of the one data period during which the input signal is of the second polarity voltage, the first, second, third, fourth, thirteenth, fourteenth, fifteenth and sixteenth switches are turned off, and the fifth, sixth, seventh, eighth, ninth, tenth, eleventh, and twelfth switches and the output control switch are turned on.

7. The semiconductor device according to claim 5, wherein the control circuit is configured such that:

during the first sub-period of the first period of the one data period during which the input signal is of the first polarity voltage, the first, second, eleventh, twelfth, thirteenth, fourteenth, fifteenth and sixteenth switches are turned on, and the third, fourth, fifth, sixth, seventh, eighth, ninth, and tenth switches and the output control switch are turned off;

during the second sub-period of the first period of the one data period during which the input signal is of the first polarity voltage, the first, second, third, fourth, thirteenth, fourteenth, fifteenth and sixteenth switches are turned on, and the fifth, sixth, seventh, eighth, ninth, tenth, eleventh, and twelfth switches and the output control switch are turned off;

during the second period of the one data period during which the input signal is of the first polarity voltage, the first, second, third, fourth, thirteenth, fourteenth, fifteenth and sixteenth switches and the output control switch are turned on, and the fifth, sixth, seventh, eighth, ninth, tenth, eleventh, and twelfth switches are turned off;

during the first sub-period of the first period of the one data period during which the input signal is of the second polarity voltage, the first, second, third, fourth, seventh, eighth, thirteenth, and fourteenth switches and the output control switch are turned off, and the fifth, sixth, ninth, tenth, eleventh, twelfth, fifteenth, and sixteenth switches are turned on;

during the second sub-period of the first period of the one data period during which the input signal is of the second polarity voltage, the first, second, third, fourth, thirteenth, fourteenth, fifteenth, and sixteenth switches and the output control switch are turned off, and the fifth, sixth, seventh, eighth, ninth, tenth, eleventh, and twelfth switches are turned on, and during the second period of the one data period during which the input signal is of the second polarity voltage, the first, second, third, fourth, thirteenth, fourteenth, fifteenth and sixteenth switches are turned off, and the fifth, sixth, seventh, eighth, ninth, tenth, eleventh, and twelfth switches and the output control switch are turned on.

8. The semiconductor device according to claim 1, wherein the differential circuit comprises:

a first current source and a second current source;

a first differential pair of a second conductivity type, the first differential pair being driven by the first current source, and having a first input and a second input that form an input pair of the first differential pair, and a pair of outputs;

a second differential pair of a first conductivity type, the second differential pair being driven by the second current source, and having a first input and a second input respectively connected to the first input and the second input of the first differential pair, and a pair of outputs;

a first cascode current mirror circuit of the first conductivity type connected to the pair of outputs of the first differential pair, the first cascode current mirror circuit has a first terminal and a second terminal;

a first floating current source having one end connected to the first terminal of the first cascode current mirror circuit;

a second floating current source having one end connected to the second terminal of the first cascode current mirror circuit; and a second cascode current mirror circuit of the second conductivity type connected to a pair of outputs of the second differential pair, the second cascode current mirror circuit having a first terminal thereof connected to the other end of the first floating current source and a second terminal thereof connected to the other end of the second floating current source, wherein the first terminal of the first cascode current mirror circuit is one of the pair of outputs of the differential circuit, and the first terminal of the second cascode current mirror circuit is the other one of the pair of outputs of the differential circuit.

9. The semiconductor device according to claim 3, wherein the differential circuit comprises:

a first differential pair of a second conductivity type, the first differential pair being driven by the first current source, and having a first input and a second input that form an input pair of the first differential pair, and a pair of outputs;

a second differential pair of a first conductivity type, the second differential pair being driven by the second current source, and having a first input and a second input respectively connected to the first input and the second input of the first differential pair, and a pair of outputs;

a first cascode current mirror circuit of the first conductivity type connected to the pair of outputs of the first differential pair, the first cascode current mirror circuit has a first terminal and a second terminal;

a first floating current source having one end connected to the first terminal of the first cascode current mirror circuit;

a second floating current source having one end connected to the second terminal of the first cascode current mirror circuit; and a second cascode current mirror circuit of the second conductivity type connected to a pair of outputs of the second differential pair, the second cascode current mirror circuit having a first terminal thereof connected to the other end of the first floating current source and a second terminal thereof connected to the other end of the second floating current source, first and second capacitance elements having respective one ends thereof connected to the second input of the differential circuit, wherein the first terminal of the first cascode current mirror circuit is one of the pair of outputs of the differential circuit, and the first terminal of the second cascode current mirror circuit is the other one of the pair of outputs of the differential circuit, wherein, in the first period of each of the one data period and the other one data period, the other end of the first capacitance element is connected to one of a pair of connection nodes between the pair of outputs of the first differential pair and the first cascode current mirror circuit, and the other end of the second capacitance element is connected to one of a pair of connection nodes between the pair of outputs of the second differential pair and the second cascode current mirror circuit, and in the second period of each of the one data period and the other one data period, the other end of the first capacitance element is connected to the high-level power supply terminal, and the other end of the second capacitance element is connected to the low-level power supply terminal.

10. The semiconductor device according to claim 4, wherein the differential circuit comprises:

a first differential pair of a second conductivity type, the first differential pair being driven by the first current source, and having a first input and a second input that form an input pair of the first differential pair, and a pair of outputs;

a second differential pair of a first conductivity type, the second differential pair being driven by the second current source, and having a first input and a second input respectively connected to the first input and the second input of the first differential pair, and a pair of outputs;

a first cascode current mirror circuit of the first conductivity type connected to the pair of outputs of the first differential pair, the first cascode current mirror circuit has a first terminal and a second terminal;

a first floating current source having one end connected to the first terminal of the first cascode current mirror circuit;

a second floating current source having one end connected to the second terminal of the first cascode current mirror circuit; and a second cascode current mirror circuit of the second conductivity type connected to a pair of outputs of the second differential pair, the second cascode current mirror circuit having a first terminal thereof connected to the other end of the first floating current source and a second terminal thereof connected to the other end of the second floating current source, first and second capacitance elements having respective one ends thereof connected to the second input of the differential circuit, wherein the first terminal of the first cascode current mirror circuit is one of the pair of outputs of the differential circuit, and the first terminal of the second cascode current mirror circuit is the other one of the pair of outputs of the differential circuit, wherein, in the first sub-period of each of the one data period and the other one data period, the other end of the first capacitance element is connected to the high-level power supply terminal, and the other end of the second capacitance element is connected to the low-level power supply terminal, and wherein in the second sub-period and the second period of each of the one data period and the other one data period, the other end of the first capacitance element is connected to one of a pair of connection nodes between the pair of outputs of the first differential pair and the first cascode current mirror circuit, and the other end of the second capacitance element is connected to one of a pair of connection nodes between the pair of outputs of the second differential pair and the second cascode current mirror circuit.

11. The semiconductor device according to claim 9, wherein the control circuit further comprises:

a seventeenth switch connected between the other end of the first capacitance element, and the one of the pair of connection nodes between the pair of outputs of the first differential pair and the first cascode current mirror circuit;

an eighteenth switch connected between the other end of the first capacitance element and the high-level power supply terminal;

a nineteenth switch connected between the other end of the second capacitance element and the one of the pair of connection nodes between the pair of outputs of the second differential pair and the second cascode current mirror circuit; and a twentieth switch connected between the other end of the second capacitance element and the low-level power supply terminal, wherein, in the first period of each of the one data period and the other one data period, the seventeenth and nineteenth switches are turned on, and the eighteenth and twentieth switch are turned off, and wherein, in the second period of each of the one data period and the other one data period, the seventeenth and nineteenth switches are turned off, and the eighteenth and twentieth switch are turned on.

12. The semiconductor device according to claim 10, wherein the control circuit further comprises:

a seventeenth switch connected between the other end of the first capacitance element, and the one of the pair of connection nodes between the pair of outputs of the first differential pair and the first cascode current mirror circuit;

an eighteenth switch connected between the other end of the first capacitance element and the high-level power supply terminal;

a nineteenth switch connected between the other end of the second capacitance element and the one of the pair of connection nodes between the pair of outputs of the second differential pair and the second cascode current mirror circuit; and a twentieth switch connected between the other end of the second capacitance element and the low-level power supply terminal, wherein, in the first sub-period of each of the one data period and the other one data period, the seventeenth and nineteenth switches are turned off, and the eighteenth and twentieth switch are turned on, and wherein, in the second sub-period and the second period of each of the one data period and the other one data period, the seventeenth and nineteenth switches are turned on, and the eighteenth and twentieth switch are turned off.

13. The semiconductor device according to claim 9, further comprising third and fourth capacitance elements having respective one ends thereof connected to the second input of the differential circuit, wherein the other end of the third capacitance element is connected to the one of the pair of connection nodes between the pair of outputs of the first differential pair and the first cascode current mirror circuit, and the other end of the fourth capacitance element is connected to the one of the pair of connection nodes between the pair of outputs of the second differential pair and the second cascode current mirror circuit.

14. A semiconductor device for driving a load of an object, a first supply voltage, and a second supply voltage being supplied to the semiconductor device, comprising:

a differential circuit having a first input and a second input, and being configured to receive an input signal through the first input, and output differential output signals generated by the differential circuit, the input signal being of a first polarity voltage or a second polarity voltage;

a first circuit driven by the first supply voltage, and having an on-state, the first circuit being configured to, in the on-state, receive the differential output signals when the input signal is the first polarity voltage that is inputted to the differential circuit, generate a first output signal and a second output signal, and output the first output signal and the second output signal, at least one of the first output signal and the second output signal being inputted to the second input of the differential circuit, the second output signal being outputted to the load;

a second circuit driven by the second supply voltage, and having an on-state, the first and second circuits being connected to the differential circuit in parallel, the second circuit being configured to, in the on-state, receive the differential output signals when the input signal is the second polarity voltage that is inputted to the differential circuit, generate a third output signal and a fourth output signal, and output the third output signal and the fourth output signal, at least one of the third output signal and the fourth output signal being inputted to the second input of the differential circuit, the fourth output signal being outputted to the load; and a control circuit configured to control one of the first and second circuits being in the on-state by connecting the differential circuit to the one of the first and second circuits.

15. The semiconductor device according to claim 14, wherein the first supply voltage is a difference potential between a first voltage and a second voltage, the second supply voltage is a difference potential between a third voltage and a fourth voltage, the first voltage being greater than the second voltage, the third voltage being greater than the fourth voltage, each of the first and second circuits includes a plurality of transistors including p-type and n-type transistors, a fifth voltage that is lower than the second voltage is supplied to the first circuit for a back gate voltage of each n-type transistor, and a sixth voltage that is greater than the third voltage is supplied to the second circuit for a back gate voltage of each p-type transistor.

16. A data driver including a semiconductor device according to claim 1, wherein the data driver is connected to a liquid crystal display device having unit pixels at respective intersections of a plurality of data lines and a plurality of scan lines, the unit pixels each having a pixel switch and a display element, and is configured to drive the data lines as a load to be driven.

17. The data driver according to claim 16, further comprising:

a first output line group that supplies one of the first polarity voltage and the second polarity voltage as an output voltage, the first output line group being a part of the plurality of data lines;

a second output line group that supplies the other one of the first polarity voltage and the second polarity voltage as an output voltage, the second output line group being a part of the plurality of data lines;

a first charge sharing line that connects respective output lines with each other in the first output line group in a first period that starts at the beginning of the one data period of an input signal; and a second charge sharing line that connects respective output lines with each other in the second output line group in a second period that starts after the first period.

* * * * *